US010307320B2

(12) United States Patent
Liran et al.

(10) Patent No.: US 10,307,320 B2
(45) Date of Patent: Jun. 4, 2019

(54) DEVICE FOR RELIEVING OR PREVENTING LOWER BACK PAIN

(71) Applicant: Backlife Ltd., Or Yehuda (IL)

(72) Inventors: Raz Liran, Rishon-LeZion (IL); Avital Eran, Petach-Tikva (IL)

(73) Assignee: Backlife Ltd., Or Yeduda (IL)

( * ) Notice: Subject to any disclaimer, the term of this patent is extended or adjusted under 35 U.S.C. 154(b) by 854 days.

(21) Appl. No.: 14/773,840

(22) PCT Filed: Mar. 11, 2014

(86) PCT No.: PCT/IL2014/050247

§ 371 (c)(1),
(2) Date: Sep. 9, 2015

(87) PCT Pub. No.: WO2014/141248

PCT Pub. Date: Sep. 18, 2014

(65) Prior Publication Data

US 2016/0022527 A1 Jan. 28, 2016

Related U.S. Application Data

(60) Provisional application No. 61/775,919, filed on Mar. 11, 2013.

(51) Int. Cl.

| | |
|---|---|
| ***A61H 1/00*** | (2006.01) |
| ***A61H 1/02*** | (2006.01) |
| ***A61G 13/12*** | (2006.01) |

(52) U.S. Cl.

CPC ..... *A61H 1/005* (2013.01); *A61G 13/123* (2013.01); *A61H 1/0214* (2013.01); (Continued)

(58) Field of Classification Search

CPC .... A61H 1/005; A61H 1/0292; A61H 1/0244; A61H 1/0214; A61H 2201/0192; (Continued)

(56) References Cited

U.S. PATENT DOCUMENTS

| | | | |
|---|---|---|---|
| 2,290,407 | A | 7/1942 | Collins |
| 2,673,737 | A | 3/1954 | Daniels |

(Continued)

FOREIGN PATENT DOCUMENTS

| | | |
|---|---|---|
| DE | 3212280 | 10/1983 |
| DE | 20105457 | 11/2001 |

(Continued)

OTHER PUBLICATIONS

Examination Report dated Sep. 18, 2017 From the Australian Government, IP Australia Re. Application No. 2014229202. (4 Pages).

(Continued)

*Primary Examiner* — Sundhara M Ganesan

(57) ABSTRACT

A device for treating or preventing lower back pain that is simpler and less costly than previous similar devices. Among the features of the device are a leg rest height adjustment arrangement that is simple to operate and provides substantially continuous height adjustment, a leg rest folding mechanism that pivotally couples the leg rest to a leg rest support shaft to place the leg rest in operative and storage positions, and a flexible cover that does not substantially change its length during height adjustment.

20 Claims, 16 Drawing Sheets

(52) U.S. Cl.
CPC ..... *A61H 1/0244* (2013.01); *A61H 1/0292* (2013.01); *A61H 2201/0161* (2013.01); *A61H 2201/0192* (2013.01); *A61H 2201/1215* (2013.01); *A61H 2201/1436* (2013.01); *A61H 2201/164* (2013.01); *A61H 2201/5035* (2013.01); *A61H 2203/045* (2013.01); *A61H 2203/0456* (2013.01)

(58) Field of Classification Search
CPC ..... A61H 2201/0161; A61H 2201/164; A61H 2201/5035; A61H 2201/1436; A61H 2203/0456; A61H 2203/045; A61H 2201/1215; A61G 13/123
See application file for complete search history.

(56) References Cited

U.S. PATENT DOCUMENTS

| | | | |
|---|---|---|---|
| 2,703,080 | A | 3/1955 | Sanders |
| 2,768,622 | A | 10/1956 | Sanders |
| 2,874,689 | A | 2/1959 | Gavelek |
| 2,893,380 | A | 7/1959 | Walker et al. |
| 3,661,149 | A | 5/1972 | Ferries |
| 3,880,150 | A | 4/1975 | Vileikis |
| 3,961,822 | A | 6/1976 | Daniel |
| 4,278,249 | A | 7/1981 | Forrest |
| 4,489,713 | A | 12/1984 | Latenser |
| 4,492,222 | A | 1/1985 | Hajianpour |
| 4,537,393 | A | 8/1985 | Kusch |
| 4,558,692 | A | 12/1985 | Greiner |
| 4,566,440 | A | 1/1986 | Berner et al. |
| 4,621,620 | A | 11/1986 | Anderson |
| 4,637,379 | A | 1/1987 | Saringer |
| 4,662,361 | A | 5/1987 | Patterson |
| 4,736,735 | A | 4/1988 | Yong |
| 4,834,072 | A | 5/1989 | Goodman |
| 4,915,377 | A | 4/1990 | Malnke et al. |
| 4,943,117 | A | 7/1990 | Brown |
| 4,949,712 | A | 8/1990 | Torii |
| 4,986,261 | A | 1/1991 | Iams et al. |
| 5,085,425 | A | 2/1992 | Collins et al. |
| 5,099,828 | A | 3/1992 | Duke |
| 5,137,015 | A | 8/1992 | Anglehart |
| 5,171,260 | A | 12/1992 | McIlwain |
| 5,176,706 | A | 1/1993 | Lee |
| 5,258,019 | A | 11/1993 | Riddle et al. |
| 5,282,835 | A | 2/1994 | Wright et al. |
| 5,336,138 | A | 8/1994 | Arjawat |
| 5,372,563 | A | 12/1994 | Chien-Nan |
| 5,399,147 | A | 3/1995 | Kaiser |
| 5,421,798 | A | 6/1995 | Bond et al. |
| 5,460,596 | A | 10/1995 | Brady |
| 5,468,215 | A | 11/1995 | Park |
| 5,500,002 | A | 3/1996 | Riddle et al. |
| 5,569,175 | A | 10/1996 | Chitwood |
| 5,601,519 | A | 2/1997 | Comereski |
| 5,772,612 | A | 6/1998 | Ilan |
| 5,823,976 | A | 10/1998 | Cain et al. |
| 5,901,581 | A | 5/1999 | Chen et al. |
| 5,984,836 | A | 11/1999 | Casali |
| 6,030,352 | A | 2/2000 | Paik |
| 6,045,192 | A | 4/2000 | Faulise |
| 6,056,706 | A | 5/2000 | Hung |
| 6,086,550 | A | 7/2000 | Richardson |
| 6,106,491 | A | 8/2000 | Gianutsos |
| 6,443,916 | B1 | 9/2002 | Ilan |
| 7,179,237 | B2 | 2/2007 | Elan |
| D548,842 | S | 8/2007 | Elnekaveh |
| D589,623 | S | 3/2009 | Olliges |
| D594,989 | S | 6/2009 | Carlson |
| D618,813 | S | 6/2010 | Doo |
| 8,371,305 | B1 | 2/2013 | Perper et al. |
| D696,407 | S | 12/2013 | Herman et al. |
| D700,667 | S | 3/2014 | Ross |
| D704,848 | S | 5/2014 | Thomas et al. |
| 2003/0154550 | A1 | 8/2003 | Murphy et al. |
| 2003/0204911 | A1 | 11/2003 | Elan |
| 2005/0222523 | A1 | 10/2005 | Splane, Jr. et al. |
| 2007/0281841 | A1 | 12/2007 | Gates |
| 2010/0013280 | A1 | 1/2010 | Groll |
| 2010/0160127 | A1 | 6/2010 | Bracci |

FOREIGN PATENT DOCUMENTS

| | | |
|---|---|---|
| DE | 202011104086 | 11/2011 |
| EP | 2319475 | 5/2011 |
| GB | 2133995 | 8/1984 |
| JP | 54-045992 | 4/1979 |
| JP | 55-148454 | 10/1980 |
| JP | 01-068066 | 3/1989 |
| JP | 07-000466 | 1/1995 |
| JP | 09-099021 | 4/1997 |
| JP | 2002-345869 | 12/2002 |
| JP | 2003-523231 | 8/2003 |
| WO | WO 01/51000 | 7/2001 |
| WO | WO 2014/141248 | 9/2014 |

OTHER PUBLICATIONS

Notice of Reason for Rejection dated Feb. 20, 2018 From the Japan Patent Office Re. Application No. 2015-562552. (5 Pages).
Translation dated Mar. 8, 2018 of Notice of Reason for Rejection dated Feb. 20, 2018 From the Japan Patent Office Re. Application No. 2015-562552. (6 Pages).
Invitation Pursuant to Rule 62a(1) EPC and Rule 63(1) EPC dated Jul. 28, 2016 From the European Patent Office Re. Application No. 14765592.2.
Communication Pursuant to Article 94(3) EPC dated Jun. 4, 2010 From the European Patent Office Re.: Application No. 00981589.5.
Communication Pursuant to Article 94(3) EPC dated Jan. 5, 2012 From the European Patent Office Re. Application No. 10181760.9.
Communication Pursuant to Article 94(3) EPC dated Aug. 6, 2008 From the European Patent Office Re.: Application No. 00981589.5.
European Search Report and the European Search Opinion dated Mar. 15, 2011 From the European Patent Office Re. Application No. 10181760.9.
Examiner's Report dated Mar. 17, 2005 From the Australian Government, IP Australia Re.: Application No. 18819/01.
International Preliminary Report on Patentability dated Sep. 24, 2015 From the International Bureau of WIPO Re. Application No. PCT/IL2014/050247.
International Search Report and the Written Opinion dated Jul. 2, 2014 From the International Searching Authority Re. Application No. PCT/IL2014/050247.
New Summons to Attend Oral Proceedings Pursuant to Rule 115(1) EPC Dated Jul. 8, 2011 From the European Patent Office Re.: Application No. 00981589.5.
Office Action dated Sep. 8, 2011 From Industrial Property Office of the Ministry of Trade and Industry of the Republic of Kosovo Re. Application No. 948.
Office Action dated Nov. 15, 2006 From the Israeli Patent Office Re.: Application No. 150593.
Official Action dated Nov. 7, 2005 From the US Patent and Trademark Office Re.: U.S. Appl. No. 10/363,759.
Official Action dated Mar. 22, 2006 From the US Patent and Trademark Office Re.: U.S. Appl. No. 10/363,759.
Requisition by the Examiner dated Dec. 19, 2007 From the Canadian Intellectual Property Office Re.: Application No. 2,396,270.
Requisiton by the Examiner dated Dec. 22, 2006 From the Canadian Intellectual Property Office Re.: Application No. 2,396,270.
Summary of the Examination Report dated Nov. 7, 2005 From the Instituto Mexicano de la Propriedad Industrial Re.: Application No. PA/a/2002/006772.
Summons to Attend Oral Proceedings Pursuant to Rule 115(1) EPC dated Apr. 21, 2011 From the European Patent Office Re.: Application No. 00981589.5.
Supplementary European Search Report dated Apr. 18, 2008 From the European Patent Office Re.: Application No.

(56) References Cited

OTHER PUBLICATIONS

Technical Examination Report dated Aug. 4, 2008 From the Brazilian Federal Public Service, Ministry of Development, Industry and Foreign Trade, National Institute of Industrial Property Re.: Application No. PI 0017005-4 and Its Translation Into English.

Technical Examination Report dated Jun. 16, 2010 From the Brazilian Federal Public Service, Ministry of Development, Industry and Foreign Trade, National Institute of Industrial Property Re.: Application No. PI 0017005-4 and Its Translation Into English.

Translation of Notice of Reason for Rejection dated Apr. 17, 2009 From the Japanese Patent Office Re.: Application No. 2001-551424.

Translation of Notice of Reason for Rejection dated Apr. 17, 2012 From the Japanese Patent Office Re. Application No. 2010-168758.

Translation of Notice of Reason for Rejection dated Oct. 20, 2009 From the Japanese Patent Office Re.: Application No. 2001-551424.

Translation of Notice of the Reason for Rejection dated Apr. 6, 2007 From the Intellectual Property Office of Korea Re.: Application No. 2002-7008898.

Translation of Official Decision of Rejection and Dismissal of Amendment dated Apr. 2, 2010 From the Japanese Patent Office Re.: Application No. 2001-551424.

Translation of Summary of the Examiner's Report dated Nov. 13, 2007 From the Brazilian Patent Office Re.: Application No. PI 0017005-4.

Supplementary Partial European Search Report and the European Search Opinion dated Nov. 3, 2016 From the European Patent Office Re. Application No. 14765592.2. (10 Pages).

Decision of Rejection dated Oct. 2, 2018 From the Japan Patent Office Re. Application No. 2015-562552 and its Machine Translation Into English. (2 Pages).

Examination Report dated Sep. 7, 2018 From the Australian Government, IP Australia Re. Application No. 2014229202. (7 Pages).

Examination Report dated Sep. 14, 2018 From the Australian Government, IP Australia Re. Application No. 2014229202. (5 Pages).

DEVICE FOR RELIEVING OR PREVENTING LOWER BACK PAIN

RELATED APPLICATIONS

This application is a National Phase of PCT Patent Application No. PCT/IL2014/050247 having International filing date of Mar. 11, 2014, which claims the benefit of priority under 35 USC § 119(e) of U.S. Provisional Patent Application No. 61/775,919 filed on Mar. 11, 2013. The contents of the above applications are all incorporated by reference as if fully set forth herein in their entirety.

PCT Patent Application No. PCT/IL2014/050247 is related to U.S. Pat. No. 5,772,612 to Daniel Ilan, U.S. Pat. No. 6,443,916 to Ori Elan, and U.S. Pat. No. 7,179,237 to Ori Elan, all of which are hereby incorporated herein by reference as if fully set forth.

FIELD OF INVENTION

The present invention, in some embodiments thereof, relates to a treatment device, and more particularly to a device useful for relieving or preventing lower back pain that is easier to assemble, use, and store, and less costly than some existing devices while providing additional functionality.

BACKGROUND OF THE INVENTION

It is well known that lower back pain affects many adults, especially middle aged and older adults. As a consequence, a great deal of suffering and disability is experienced by a large fraction of the population resulting, among other things, lost workdays and greatly diminished quality of life.

A brief physiological analysis will help illustrate the cause of back pains and give an insight as to possible remedies.

The spinal column consists of thirty-three vertebrae which are joined together by cartilage tissue and ligaments. The upper twenty-four vertebrae are discrete and movable while the lower nine vertebrae are fixed. Five of the lower nine vertebrae are fused together to form the sacrum while the terminal four vertebrae are normally fused to form the coccyx. The normal spinal column may be considered to have seven cervical, twelve thoracic, five lumbar, five sacral, and four coccygeal vertebrae. Mobility of the vertebrae in the cervical, thoracic, and lumbar regions is relatively free compared with movement of the fused vertebrae of the sacrum and coccyx which is relatively constrained.

The main causes of common back pain are the continual stresses and strains experience by the lower back region which is the major, albeit not the sole, weight-supporting element of the upper body.

These stresses and strains eventually cause the damage symptomatic of back pain in that the cartilage material forming the discs separating the vertebrae is worn away over a period of time. In its extreme pathological condition, the patient may develop ankylosing spondylitis, namely, the partial, bent-down stiffening of the spinal column.

The sensation of pain is felt because the distance separating the vertebrae becomes narrower, causing pressure to be exerted on the nerve roots which extend from the spinal cord.

Due to the degenerative nature of the causes of back pain of this sort there is currently no permanent relief available, except for surgery where appropriate. There are, however, known procedures for the relief of pain in the lumbar region of the back. These procedures involve the stretching of the lower back to achieve the separation of the discs in the affected lumbar area. However, these treatments typically require the use of weights and other mechanical equipment and must be undertaken only under close professional supervision.

U.S. Pat. No. 5,772,612 to Daniel Ban, referred to above, discloses a device suitable for home use. With the '612 device, a user lies on a body-supporting surface with his or her knees over a frame, and the lower legs on a leg rest. The lower end of the device contacts the body-supporting surface, acting as a fulcrum. When the user pushes against the device, the device pivots so as to tend to lift the user's legs along a slightly arched path. A motor-driven version of the device is also disclosed.

The devices of the aforementioned '612 patent represent a useful attempt to provide a device for relieving lower-back pain suitable for home use. Specifically, with reference to FIGS. 1A-1C, a trained physiotherapist typically performs an initial lifting movement by raising the subject's legs from the position of FIG. 1A to that of FIG. 1B so as to neutralize the arched concavity of the back. This is followed by a primarily horizontal pulling motion (FIG. 1C), thereby applying tension tending to relieve pressure between the lumbar vertebrae. The tension is then released, thereby allowing the body to return under the action of gravity to a resting position.

U.S. Pat. Nos. 6,443,916 and 7,179,237, both to Ori Ilan, referred to above (the "Ori Ilan inventions" or the "'916 and '237 patents"), disclose another useful device for home use to help reduce and/or eliminate lower back pain.

SUMMARY OF THE INVENTION

According to an aspect of some embodiments of the present invention there is provided a device for treating or preventing lower back pain having a leg rest, a leg rest support shaft, and a leg rest folding mechanism that pivotally couples the leg rest to the leg rest support shaft.

According to some embodiments, the leg rest folding mechanism includes a pin mechanism and a guide track which cooperate to permit the leg rest to slide and pivot relative the leg rest support shaft.

According to some embodiments, the leg rest folding mechanism includes a slide mechanism mounted on the leg rest support shaft, wherein the pin mechanism comprises pints that project outwardly from the slide mechanism, and are slidably received in a track in the leg rest to permit the leg rest to slide toward a front end of the device and to pivot downwardly to the folded position.

According to some embodiments, the track is comprised of a pair of slots extending from proximate to the front end to proximate to the back end of the leg rest.

According to some embodiments, a latch is provided to hold the leg rest in its non-folded position.

According to some embodiments, the leg rest lies along the front of the leg rest support shaft in the folded position.

According to an aspect of some embodiments of the present invention there is provided a device for treating or preventing lower back pain having a leg rest, a leg rest support assembly including a leg rest support shaft attached to the leg rest, a drive unit for imparting cyclic motion to the leg rest that emulates the motion performed by a physiotherapist, a bellows forming a flexible cover for an upper end of a housing that contains the drive unit, and a leg rest height adjustment mechanism that cooperates with the leg rest support assembly to raise and lower the leg rest relative to the drive unit, wherein the length of the bellows is substantially unchanged during the height adjustment.

According to some embodiments, the bellows is attached at its lower end to the housing for the drive unit, and is attached at it upper end to the drive unit proximate to the upper end thereof.

According to some embodiments, the bellows is attached at its upper end to a drive shaft for the leg rest support assembly comprised in the drive unit.

According to some embodiments, the leg rest height adjustment mechanism is captively mounted on the drive shaft and the upper end of the bellows is attached to the drive shaft below the leg rest height adjustment mechanism.

According to some embodiments, the leg rest height adjustment mechanism is captively mounted in a groove on the drive shaft and the upper end of the bellows is attached to the drive shaft in the same groove below the height adjustment mechanism.

According to some embodiments, the groove provides friction to resist rotation of the collar after adjustment of the leg rest height.

According to some embodiments, the leg rest height adjustment mechanism does not substantially change its axial position during leg rest height adjustment, so the length of the bellows does not change as the leg rest raised and lowered.

According to some embodiments, the bellows is only long enough to accommodate the cyclic motion of the drive shaft.

According to an aspect of some embodiments of the present invention there is provided a device for treating or preventing lower back pain having a leg rest, a leg rest support assembly, a drive unit for imparting motion to the leg rest that emulates the motion performed by a physiotherapist, and a mechanism operative to move the leg rest support assembly relative to the drive unit to provide substantially continuous adjustment of the height of the leg rest.

According to some embodiments, the leg rest support assembly and the leg rest height adjustment mechanism include parts that cooperate to raise and lower the leg rest.

According to some embodiments, the leg rest support assembly includes a leg rest support shaft coupled to the leg rest and the height adjustment mechanism cooperates with the leg rest support shaft to raise and lower the leg rest.

According to some embodiments, the height adjustment mechanism is an internally threaded collar that engages threads on the leg rest support shaft.

According to some embodiments, the pitch of the threads on the collar and the leg rest support shaft is in the range of about 1 mm to about 3 mm.

According to some embodiments, the threaded collar is captively mounted proximate to the upper end of the drive shaft.

According to some embodiments, the drive unit includes a motor, a drive shaft that couples the motor to the leg rest support assembly, a motion converter between the motor and the drive shaft that imparts a cyclical path of motion to the leg rest support assembly, and a guide mechanism for providing lateral support for the drive shaft as it moves along the path of motion imparted by the motion converter.

According to some embodiments, the guide mechanism is comprised of guide rods located on opposite sides of the drive shaft that are attached at their respective upper ends to the drive shaft and are resiliently coupled at their lower ends to a support for the motion converter, and wherein the guide rods are received in longitudinal tracks located in the housing on opposite sides thereof.

According to some embodiments, the guide rods include head portions that are loosely connected to projections extending from the drive shaft.

According to some embodiments, the guide mechanism includes compression springs coupled to each of the guide rods that provide the resilient coupling and upward force when compressed for counterbalancing the weight of the user's legs.

According to some embodiments, the guide rods include head portions that are loosely connected to projections extending from the drive shaft and to compression springs that provides the resilient coupling.

According to some embodiments, the motion converter is a crank that includes a first end part coupled to the motor, a second end part, an offset center part rotatably coupled by a bearing to the drive shaft; and end bearings rotatably supporting the first and second end parts.

According to some embodiments, the lower ends of the compression springs are mounted on the motion converter end bearings and the upper ends are in contact with the head portions.

According to some embodiments, the drive shaft is tubular, and is configured to receive a lower end of the leg rest support shaft in a telescoping relationship.

According to some embodiments, the leg rest support shaft and the drive shaft are configured such that leg rest support shaft can be received in the drive shaft in only one orientation.

According to some embodiments, the cross-section of the leg rest support shaft is a polygon threaded at its corners.

According to some embodiments, the leg rest is pivotally mounted on the leg rest support assembly so that the leg rest can be moved from an operative position to a folded position for storage.

According to some embodiments, the device further includes a bellows, a lower end of which is captively mounted at the top of a housing that contains the drive unit, and an upper end of which is captively mounted proximate to the upper end of the drive unit.

According to some embodiments, the length of the bellows does not change substantially during height adjustment of the leg rest.

According to an aspect of some embodiments of the invention, there is provided a device for treating or preventing lower back pain having a leg rest a leg rest support assembly, a drive unit mounted in a base housing, wherein the drive unit includes a drive shaft that projects through an open top of the housing for imparting motion to the leg rest support assembly, and a flexible cover for the open top of the housing attached at it lower end at the top of the housing and at its upper end to an element mounted on the drive shaft.

According to some embodiments, the flexible cover is a bellows.

According to some embodiments, the length of the cover is in the range of about 5 to about 15 cm.

According to some embodiments, the length of the cover is about 10 cm.

As used herein, the term "emulate" is to be understood in the sense of substantial functional, i.e., therapeutic equivalence, but not necessarily exact duplication.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods, and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF EMBODIMENTS OF THE INVENTION

Overview

Figure 1A:
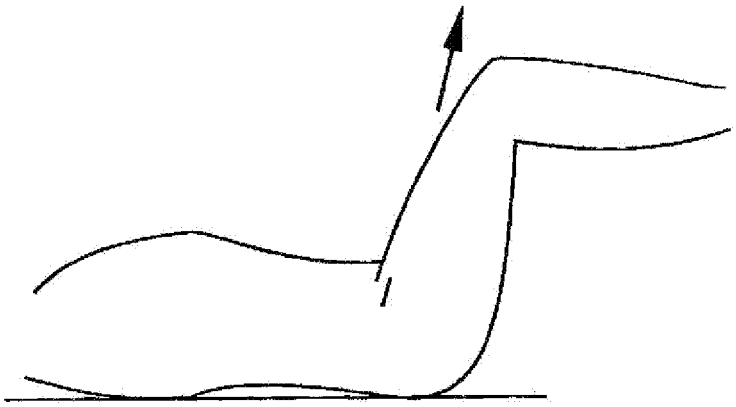
FIGS. 1A-1C show schematically the back therapy motions employed by a physiotherapist when treatments are performed manually.

The present invention, in some embodiments thereof, relates to a treatment device, and more particularly to such a device useful for relieving or preventing lower back pain that is easier to assemble, use, and store and less costly than some existing devices while providing additional functionality.

Exemplary Embodiments

Some embodiments of the present invention pertain to a device for treating or preventing lower back pain that includes a leg rest, a leg rest support shaft, and a leg rest folding mechanism that pivotally couples the leg rest to the leg rest support shaft. Folding may reduce the space required for storage when the device is not in use.

Optionally, in some such embodiments, the leg rest folding mechanism includes a pin mechanism and a guide track which cooperate to permit the leg rest to slide and pivot relative the leg rest support shaft.

Optionally, in some such embodiments, the leg rest folding mechanism includes a slide mechanism mounted on the leg rest support shaft, the pin mechanism includes pins that project outwardly from the slide mechanism, and are slidably received in a track in the leg rest to permit the leg rest to slide toward a front end of the device and to pivot downwardly to the folded position.

Optionally, in some such embodiments, the guide track is a pair of slots extending from proximate to a front end to proximate to a back end of the leg rest.

Optionally, some such embodiments include a latch that holds the leg rest in its non-folded position.

Optionally, in some such embodiments, the leg rest lies along the front of the leg rest support shaft in the folded position.

Some embodiments of the present invention pertain to a device for treating or preventing lower back pain that includes a leg rest, a leg rest support assembly that includes a leg rest support shaft attached to the leg rest, a drive unit for imparting cyclic motion to the leg rest that emulates the motion performed by a physiotherapist, a bellows forming a flexible cover for an upper end of a housing that contains the drive unit, and a leg rest height adjustment mechanism that cooperates with the leg rest support assembly to raise and lower the leg rest relative to the drive unit.

Optionally, the device is designed such that the length of the bellows is substantially unchanged during the height adjustment. Optionally, the bellows is attached at a lower end to the housing for the drive unit, and is attached at an upper end proximate to an upper end of the drive unit. Optionally, the bellows is attached at its upper end to a drive shaft for the leg rest support assembly comprised in the drive unit.

In some such embodiments, the leg rest height adjustment mechanism is captively mounted on the drive shaft and the upper end of the bellows is attached to the drive shaft below the leg rest height adjustment mechanism.

In some such embodiments, the leg rest height adjustment mechanism is captively mounted in a groove on the drive shaft and the upper end of the bellows is attached to the drive shaft in the same groove below the height adjustment mechanism.

Optionally, the leg rest height adjustment mechanism does not substantially change its axial position during leg rest height adjustment, whereby the length of the bellows does not substantially change as the leg rest is raised and lowered. In some such embodiments, the bellows is only long enough to accommodate the cyclic motion of the drive shaft. This can allow the bellows to be of a shorter length. The cover material is costly, and the shorter length may contribute to reduced cost.

Some embodiments of the present invention pertain to a device for treating or preventing lower back pain having a leg rest, a leg rest support assembly, a drive unit for imparting motion to the leg rest that emulates the motion performed by a physiotherapist, and a mechanism operative to move the leg rest support assembly relative to the drive unit to provide substantially continuous adjustment of the height of the leg rest.

In some such embodiments, the leg rest support assembly and the leg rest height adjustment mechanism include parts that cooperate to raise and lower the leg rest.

Optionally, the leg rest support assembly includes a leg rest support shaft coupled to the leg rest, and the height adjustment mechanism cooperates with the leg rest support shaft to raise and lower the leg rest.

Optionally, in some such embodiments, the height adjustment mechanism is an internally threaded collar that engages threads on the leg rest support shaft. Optionally, the pitch of the threads on the collar and the leg rest support shaft is in the range of about 1 mm. to about 3 mm. Optionally, the pitch of the threads is about 1.5 mm. The close pitch may contribute friction to help prevent the leg rest height from changing during use.

In some such embodiments, the threaded collar is captively mounted proximate to the upper end of the drive shaft.

In some such embodiments, the drive unit is mounted in a housing at the base of the device, and includes a motor, a drive shaft that couples the motor to the leg rest support assembly, a motion converter between the motor and the drive shaft that imparts a cyclical path of motion to the leg rest support assembly, and a guide mechanism for providing lateral support for the drive shaft as it moves along the path of motion imparted by the motion converter.

In some such embodiments, the guide mechanism is comprised of guide rods located on opposite sides of the drive shaft that are attached at their respective upper ends to the drive shaft and are resiliently coupled at their lower ends to a support for the motion converter. Optionally, the guide rods are received in longitudinal tracks located in the housing on opposite sides thereof. Optionally, the guide rods include head portions that are loosely connected to projections extending from the drive shaft.

In some such embodiments, the guide mechanism includes compression springs coupled to each of the guide rods that provide the resilient coupling and upward force when compressed for counterbalancing the weight of the user's legs.

In some embodiments, the motion converter is a crank that includes a first end part coupled to the motor, a second end part, an offset center part rotatably coupled by a bearing to the drive shaft, and end bearings rotatably supporting the first and second end parts.

Optionally, in some embodiments, the lower end of the compression springs are mounted on the motion converter end bearings and the upper ends are in contact with the head portions.

In some such embodiments, the drive shaft is tubular, and is configured to receive a lower end of the leg rest support shaft in a telescoping relationship.

Optionally, the leg rest support shaft and the drive shaft are configured such that leg rest support shaft can be received in the drive shaft in only one orientation. In some such embodiments, the cross-section of the leg rest support shaft is a polygon threaded at its corners.

In some embodiments, the lower end of the bellows is captively mounted at the top of a housing that contains the drive unit, and its upper end is captively mounted proximate to the upper end of the drive unit. This construction allows the length of the bellows to remain substantially constant during height adjustment of the leg rest.

Some embodiments of the present invention pertain to a device for treating or preventing lower back pain that includes a leg rest, a leg rest support assembly, a drive unit mounted in a base housing, a drive shaft that is part of the drive unit that projects through an open top of the housing for imparting motion to the leg rest support assembly, and a flexible cover for the open top of the housing attached at it lower end at the top of the housing and at its upper end to an element mounted on the drive shaft. Optionally, the flexible cover is a bellows, the length which is in the range of about 5 to about 15 cm. Optionally, the length is about 10 cm.

Optional Features of Exemplary Embodiments

One or more of the following features may be included in any of the embodiments of the invention as described herein, unless clearly indicated otherwise:

a) the drive unit may be comprised of an electric motor, an eccentric motion converter mechanism, for example, a crank, and a drive shaft connected to a leg rest support assembly by a telescoping coupling;

b) the motor may be a variable speed motor having its output shaft directly coupled to an eccentric motion converter;

c) the motor may be a conventional gear motor or a motor and a separate speed reduction mechanism that couples the motor to the motion converter;

d) the motion converter may be rotatably supported by an end bearing at one end mounted on the inside of a drive unit housing;

e) the motion converter may be rotatably supported by two end bearings mounted on the inside of a drive unit housing;

f) the drive unit housing may be comprised of a base and a body, with the bearings for supporting the motion converter attached to the inside of the housing body;

g) parts of the drive unit, for example, the motor and speed reduction unit if separate from the motor, may be configured to rest on, but are not fixedly mounted on the drive unit housing base;

h) the leg rest support assembly may include a leg rest support shaft that extends from the underside of the leg rest, and a mechanism that provides height adjustment for the leg rest, by selectably positioning the leg rest support relative to the drive unit;

i) the leg rest height adjustment mechanism may be an internally threaded collar or nut that engages threads on the leg rest support shaft;

j) the collar may be captively and rotatably attached to the drive shaft;

k) the leg rest support shaft may be telescopically received in a tubular part of the drive shaft;

l) rotation of the leg rest height adjustment collar permits substantially continuously variable leg rest height adjustment;

m) the cross-section of the leg rest support shaft may be polygonal, for example, square or pentagonal, or other non-circular shape;

o) a non-circular leg rest support shaft may have discontinuous threads, for example, only at the corners, to engage threads on the adjusting collar;

p) the interior of the drive shaft and the exterior of the leg rest support shaft may be configured so that the leg rest support shaft fits into the drive shaft in only one orientation, thereby assuring that the leg rest is properly positioned relative to the drive unit housing;

q) the small pitch of the threads on the adjusting collar and the leg rest support shaft provides friction that helps prevent the leg rest support shaft from changing position after desired height setting is made;

r) the collar may captively mounted by means of one or more projections or tabs that extend radially inwardly and engage with a complementary groove on the drive shaft;

s) a flexible cover, for example, a bellows, may be provided for the top of drive unit housing that is compressed and extended as the leg rest support shaft executes its path of motion, the configuration of which is substantially independent of the leg rest height adjustment;

t) the bellows may be captively attached at its lower end to the top of a drive unit housing and at its upper end proximate to the top of the drive shaft;

u) the bottom of the leg rest height adjustment collar is captively attached to the drive shaft with the top of the bellows attached the drive shaft below the collar;

v) because the collar does not move axially relative to the drive shaft, the length of the bellows may less than, and in some cases, substantially less than, the range of height adjustability of the leg rest;

w) a folding mechanism may be provided that allows the leg rest to be folded to a storage position;

x) the folding mechanism may be a slide/pivot arrangement mounted between the leg rest and the leg rest support shaft, and is configures so the leg rest can side toward the front of the device and pivot downward to rest along the front of the leg rest support shaft for storage;

y) the slide/pivot arrangement includes oppositely extending pivot guide elements that engage slots on the leg rest, on which the leg rest slides and pivots from an operative position generally perpendicular to the leg rest support shaft to a storage position lying along one side, for example, the front side, of the support shaft;

z) a latch, for example, a spring clip, may be provided to hold the leg rest in its operative position; and aa) the leg rest may be formed as a single molded part, containing holes in its surface, which may contribute to user comfort and possible cost reduction.

The aspects and features of the embodiments of the invention described above, and generally throughout the detailed description herein, individually and collectively contribute in various ways to the advantageous features of the invention, for example, ease of assembly and reduced cost, contributing to a desirable price point for the device. Further, because embodiments of the invention are lighter in weight and more easily storable due to the foldable leg rest, they are easier to handle, a consideration of particular importance for back pain sufferers.

The new device also may contribute to better treatment results due to its continuous height adjustment mechanism since it may allow each user to accurately set the unit to exact height required for his or her use. Also the base of the unit includes two holes that may allow for easier pulling the unit towards the body if required.

Before explaining at least one embodiment of the invention in further detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways. In particular, it is to be understood that the exact shapes illustrated are intended to be exemplary only, and that numerous variations within the scope of embodiments of the invention can provide substantially the same functionality.

Emulated Therapeutic Action

Figure 1B:
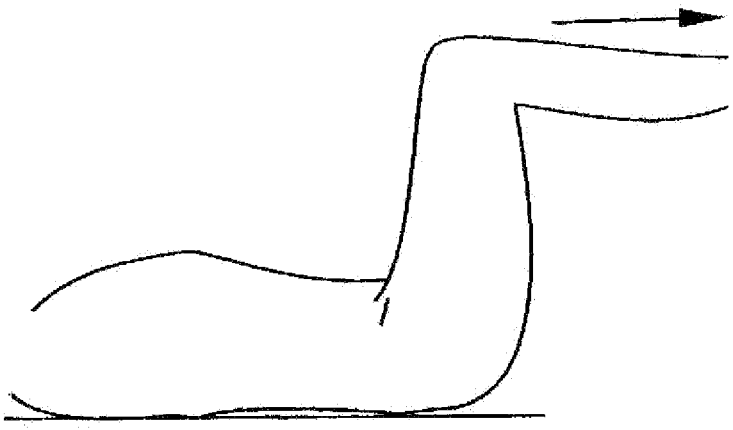
Figure 1C:
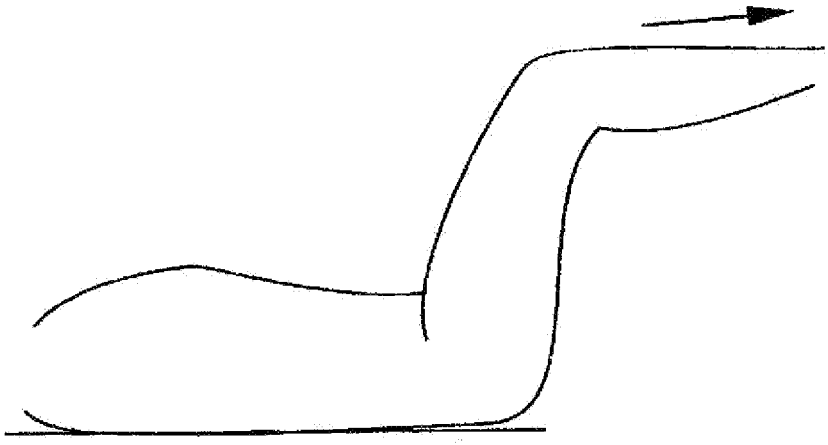

Referring again briefly to FIGS. 1A-1C, the device of the invention is intended to emulate (in the sense defined above) the motions employed by a trained physiotherapist performing therapy manually. When viewed from the side, this motion is essentially elliptical, with the major axis of the ellipse running axially relative to a leg rest support shaft. FIGS. 1A-1C show an initial lifting movement that raises the subject's legs from the position of FIG. 1A to that of FIG. 1B so as to neutralize the arched concavity of the back. This is followed by a primarily horizontal pulling motion (FIG. 1C), thereby applying tension tending to relieve pressure between the lumbar vertebrae. The tension is then released, thereby allowing the body to return to a resting position.

Schematic Illustration of Representative Embodiments

Figure 2A:
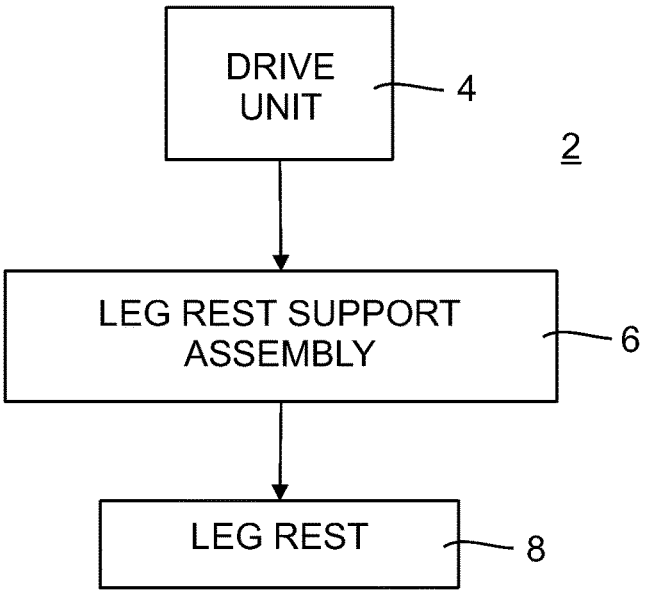
FIG. 2A is schematic block diagram that illustrates exemplary features of some embodiments of the invention at a high level of abstraction.
Figure 2B:
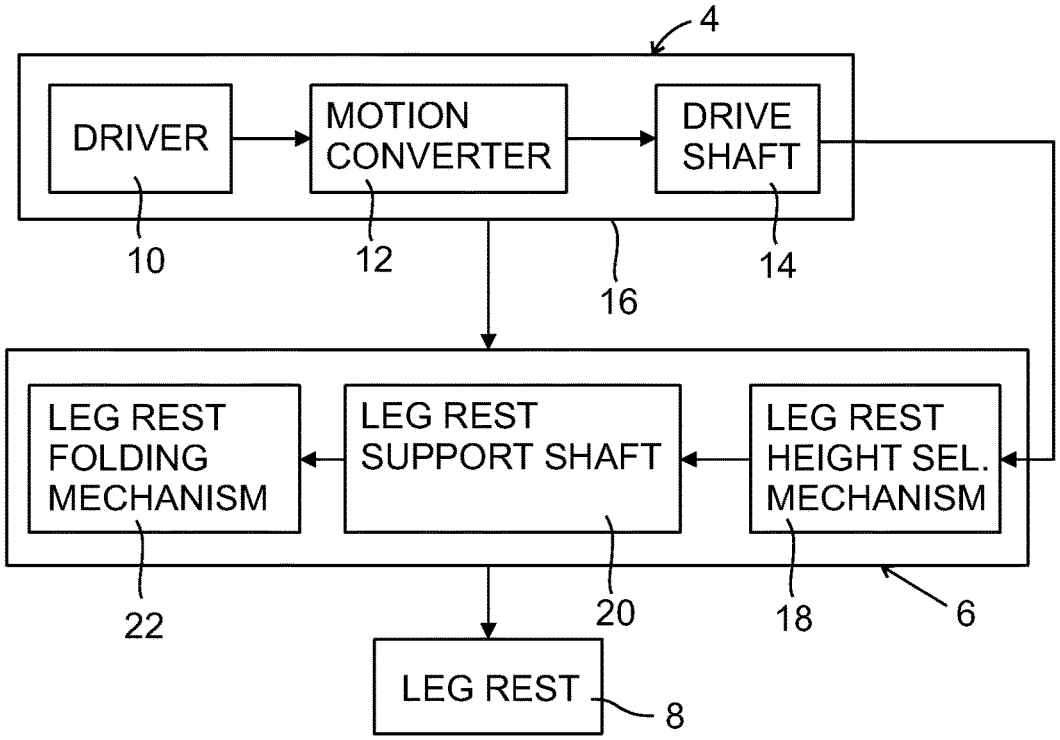
FIG. 2B is a schematic block diagram that illustrates the device of FIG. 2A in further detail.

FIGS. 2A and 2B are schematic block diagrams showing exemplary features of a device, generally indicated at 2, according to some embodiments of the invention. FIG. 2A represents device 2 at a high level of abstraction. As illustrated, device 2 is comprised of a drive unit 4, a leg rest support assembly 6 coupled to and driven by drive unit 4, and a leg rest 8 carried by leg rest support assembly 6.

FIG. 2B illustrates device 2 at a more detailed level. Here, drive unit 4 is shown to include a driver 10, a motion converter 12 coupled to driver 10, and a drive shaft 14 coupled to motion converter 12. The components of drive unit 4 are advantageously all contained in and directly or indirectly mounted in a housing 16 as more fully described below.

Further, in the exemplary embodiment as shown in FIG. 2B, leg rest support assembly 6 is comprised of a leg rest height adjustment or selection mechanism 18, a leg rest support shaft 20 coupled to drive shaft 14 through height adjustment mechanism 18, and optionally in addition, a folding mechanism 22 that couples leg rest support shaft 20 to leg rest 8. The height of leg rest 8 is adjusted relative to drive unit 4 by operation of height adjustment mechanism 18. Optionally, height adjustment mechanism 18 is captively mounted on drive unit 4, for example, on drive shaft 14.

As described below, the design of height adjustment mechanism 18 permits substantially continuous height adjustment as described below. This allows more accurate height adjustment for each user which may contribute to better individualized treatment. Also, the design of the height adjustment mechanism is quite simple and consequently requires fewer components, less material and shorter assembly time. These features may contribute to the desirable price point.

Optional folding mechanism 22 allows the leg rest to be conveniently folded to a storage position.

Various options exist for driver 10 as described below. For simplicity, these will all be referred to simply as a "motor".

Motor 10 is connected to motion converter 12, which may be, for example, an eccentric motion crank. This, in turn, converts the motor output shaft rotation into a desired path of motion for drive shaft 14. The resulting motion of drive shaft 14 is imparted to leg rest support shaft 20 which imparts a path of motion to leg rest 8 that emulates (in the sense previously indicated) the therapeutic motion described in connection with FIGS. 1A-1C. In some embodiments, motion of leg rest 8 follows a substantially elliptical path. Alternatively, however, the path may be circular, or near circular.

In some embodiments, optional leg rest folding mechanism 22 is a slide-pivot mechanism that allows leg rest 8 to be pivoted to a compact position for convenient storage.

Structural Illustration of Features of Some Embodiments

The details of the construction of some exemplary embodiments of the invention are shown in FIGS. 3-18.

Preliminarily, it should be noted that the structural parts described below are advantageously molded of a suitably strong polymer, for example, glass-filled polypropylene, whenever possible to help minimize the weight of the device. Optionally, some parts may be metal, or other polymers as indicated below.

Figure 3:
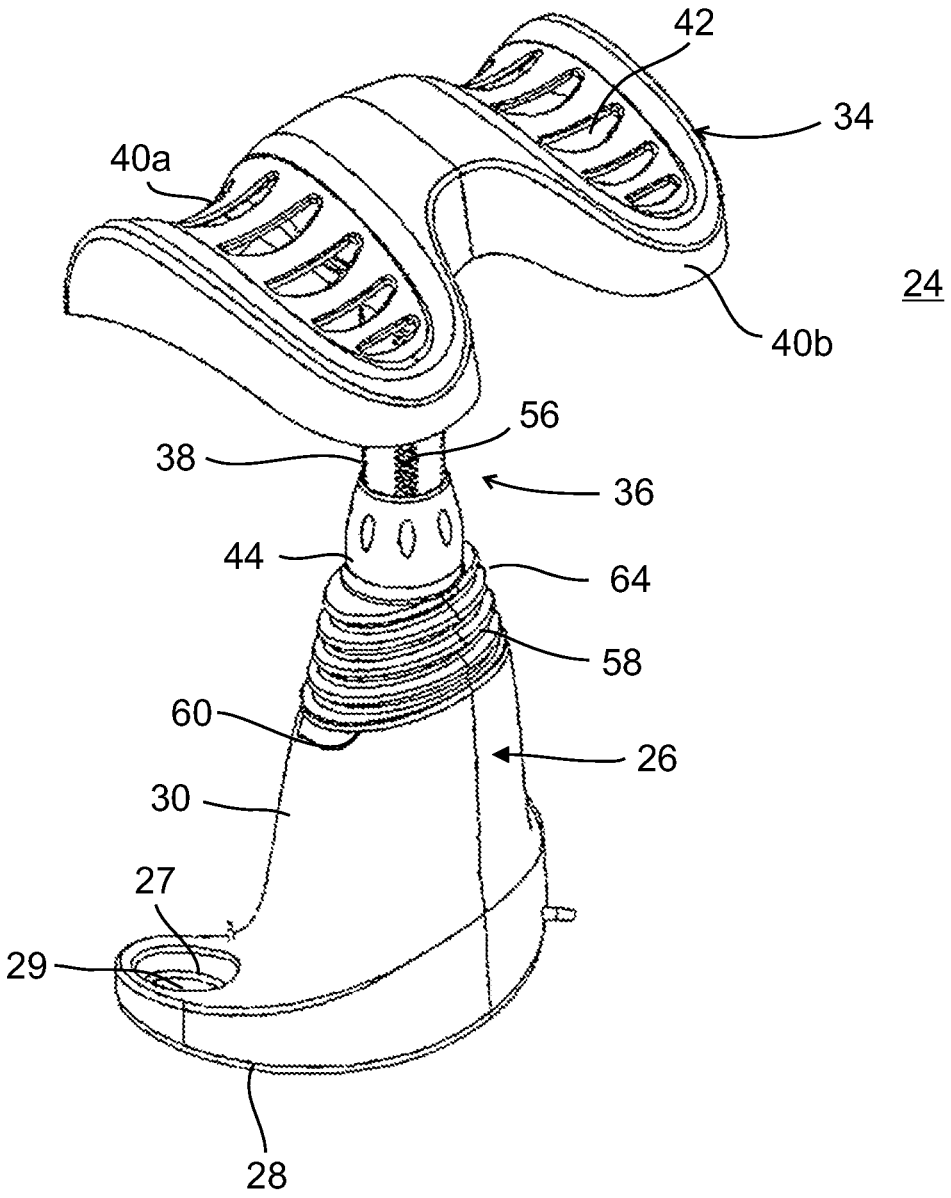
FIG. 3 is a perspective view of an exemplary embodiment of the invention seen from beyond the feet of a user (sometimes referred to below as the "front end") and generally from the left side (relative to the front end)
Figure 4:
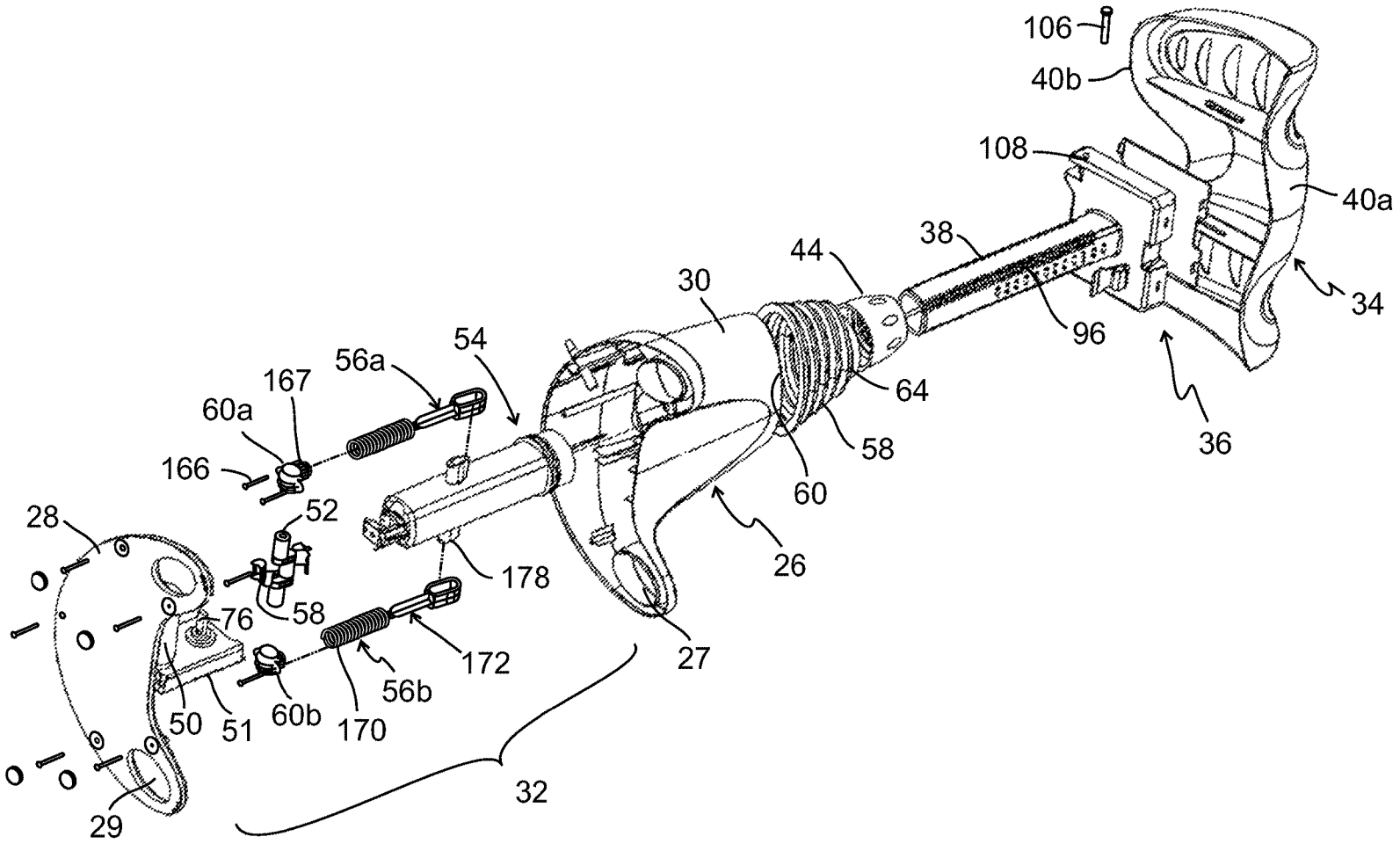
FIG. 4 is an exploded perspective view as seen from the rear and below of exemplary internal features of the device of FIG. 3 according to some embodiments of the invention.

FIG. 3 is a perspective view seen generally from the front of the device, i.e., from beyond the feet of a user and from the left side relative to the front of the device. FIG. 4 is an exploded perspective view seen from rear and the left side.

The device, generally designated 24, is comprised of a housing 26 including a bottom plate 28 optionally configured to rest firmly on a floor, and an upwardly extending body portion 30 within which the drive unit described in connection with FIGS. 2A and 2B is contained. Structural details of an exemplary drive unit are described in further detail below.

Still referring to FIG. 3, leg rest 34 is attached to the top of a leg rest support assembly, generally designated 36, that is comprised of a leg rest support shaft 38, and a leg rest height adjusting element 44. In some embodiments, leg rest support assembly 36 also includes a leg rest folding mechanism described below by which leg rest 34 is attached to support shaft 38.

In some embodiments, leg rest 34 is shaped to support the back of the user's legs, with the backs of the upper ends of the calves at leg rest back end 40*a* and the feet extending beyond leg rest front end 40*b*. The position of the legs, with the knees bent is shown in FIGS. 1A-1C.

Optionally, leg rest 34 may be formed with a plurality of longitudinally spaced slots 42 running across the area on which the legs are positioned. This may contribute to weight and cost reduction, and may also provide ventilation to increase user comfort.

Optionally, slots 42 may be differently configured or omitted altogether.

FIG. 4 illustrates some exemplary internal details of a device such as illustrated in FIG. 3. In connection with FIG. 4, it should be understood that some structural parts are omitted or shown, but not described, to avoid obscuring the description of other parts and the overall structure.

As shown in FIGS. 3 and 4, drive unit housing 26 includes holes 27 on each side of housing body 30 and corresponding holes 29 in base plate 28. These can help the user pull the unit towards his or her body, while the unit is in contact with the body.

Also shown in 4, the drive unit, generally indicated at 32 is comprised of a drive motor 50, a motion converter 52, motion converter end support bearings 60*a* and 60*b*, a drive shaft 54, a motion converter main bearing 58, a pair of spring mechanisms 56*a* and 56*b*, and various items of mounting hardware as described more fully below.

Figure 11:
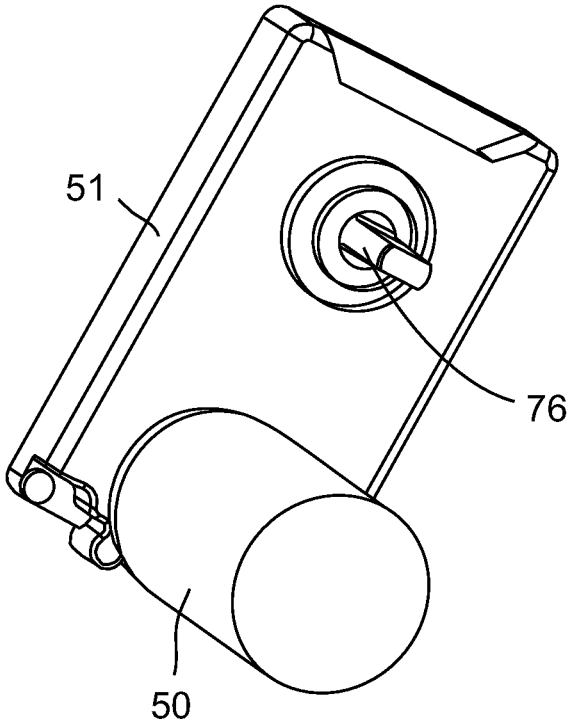
FIG. 11 is a perspective view seen generally from one side of an exemplary configuration for a drive motor and motor speed reduction gearing according to some embodiments of the invention.

Exemplary, but non-limiting, options for motor 50 include (a) a conventional gear motor, i.e., an integrated unit including a built-in speed reduction mechanism, (b) a motor coupled to a separate speed reduction mechanism, or (c) a variable speed motor. Other suitable and desired motor options may also be employed. In some exemplary embodiments, the motor (or speed reduction gearing) output shaft speed is in the range of about 16-30 RPM, for example, 18 RPM, or higher or lower values if desired. In FIGS. 4 and 11, a speed reduction mechanism is shown separately at 51 for purposes of illustration.

In some exemplary embodiments, motion converter 52 is a crank mechanism as described below. Crank mechanism 52 is mounted on end bearings 60*a* and 60*b*, and is connected to drive shaft 54 by main bearing 58. In some embodiments, it may be possible to employ only a single end bearing.

In some exemplary embodiments, end bearings 60*a* and 60*b* are mounted on the interior of housing body 30, for example, on suitable mounting elements (not shown), which may be formed integrally with the housing body. This may also contribute a simpler design, less assembly time, and lower cost.

In some embodiments, drive motor 50 rests on bottom plate 28, held, for example, by suitably shaped brackets (not shown) and retained in place when bottom plate 28 is attached to housing body 30. Alternatively and additionally, it may also rest or be attached to other parts of the housing body. In the illustrated embodiment, it is attached to housing body 30 by crank mechanism 52 and end bearings 60*a* and 60*b* by means of screws 166, as described below.

A control circuit, for example, an integrated circuit (not shown), designed to provide motor speed adjustment in embodiments having a variable speed motor, and/or treatment duration may also be contained in housing body 30. Optionally, the speed adjustment and treatment duration functions can be combined to provide one or more programmed treatment regimens. Multi-position switches or any other suitable and desired interface arrangement (also not shown) may be mounted in body 30 and externally accessible for convenient user operation.

Figure 5:
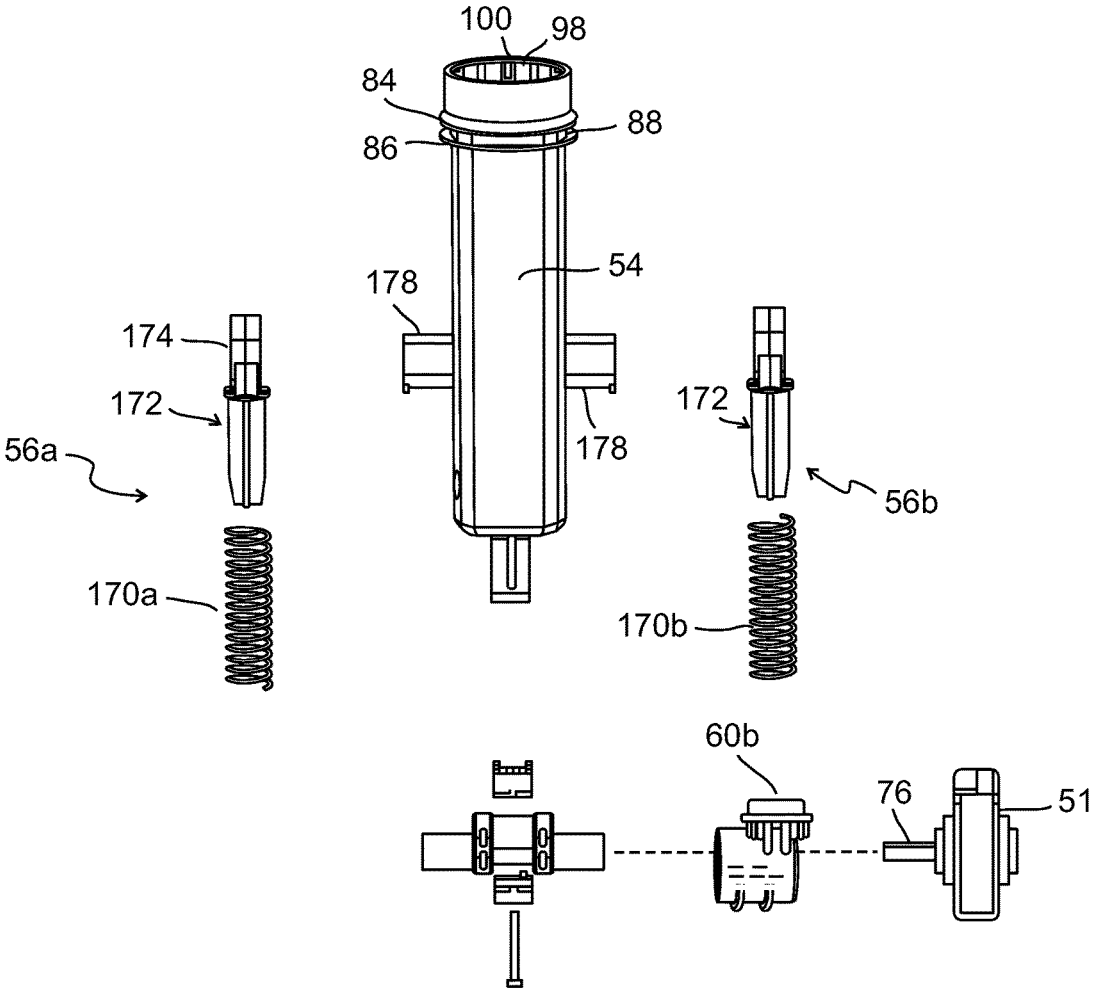
FIG. 5 is an enlarged exploded view of a portion of FIG. 4 partly in perspective, and partly in rear elevation.
Figure 6:
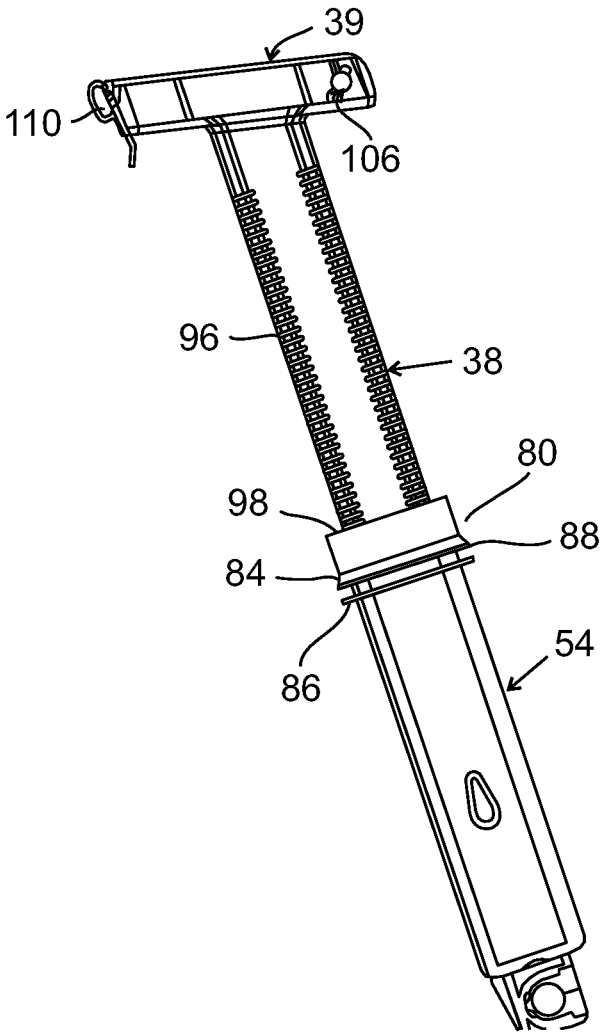
FIG. 6 is a side elevation of a drive shaft, a leg rest support shaft, and a leg rest folding mechanism according to some embodiments of the invention.

Further structural features of the device illustrated in FIGS. 3 and 4 are shown in FIGS. 5-13B and are described below. FIG. 5 is an enlarged exploded view of a portion of drive unit 32 shown in FIG. 4 mainly in rear elevation, and FIG. 6 is a side elevation of drive shaft 54, leg rest support shaft 38, and leg rest folding mechanism 39.

As shown in these figures, according to some embodiments, to permit adjustment of the height of leg rest 34, leg rest support shaft 38 and drive shaft 54 are configured to be moveable relative to each other. Advantageously, but by way of a non-limiting example, drive shaft 54 is tubular, and leg rest support shaft 38 is telescopically received within an opening 98 at the top of drive shaft 54.

Figure 7:
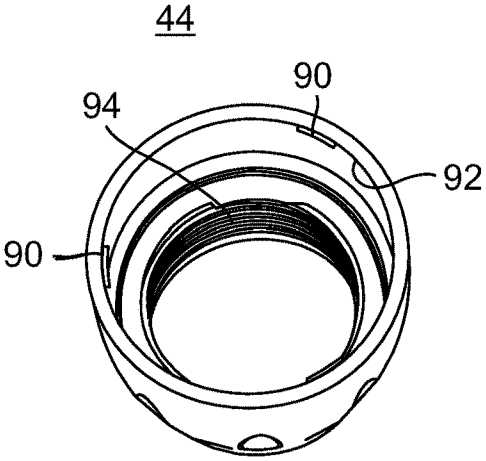
FIG. 7 is an enlarged bottom perspective view, shown inverted, of a leg rest height-positioning collar according to some embodiments of the invention.

Referring to FIG. 7, an exemplary leg rest height adjustment mechanism 44 is an internally threaded collar or nut configured to be rotatably and captively mounted at the upper end 80 of drive shaft 54, for example, in a peripheral groove 88 defined by longitudinally spaced rings 84 and 86 (see FIG. 6). Collar 44, in turn, includes one or more (for example, two, three, four or more) tabs 90 integrally molded on collar 44 that project radially inwardly at collar lower end 92.

Tabs 90 are sufficiently resilient that they can be snapped into groove 88 by downward pressure on collar 44 to retain the collar captive on the drive shaft, and also, to allow it to be removed if necessary. Groove 88 is sufficiently wider than the thickness of tabs 90 that collar 44 is able to rotate freely.

Height adjustment is provided by threads 94 inside collar 44 that engage with complementary threads 96 on leg rest support shaft 38 (see FIGS. 4 and 6). Thus, with leg rest support shaft 38 fitting telescopically into drive shaft 54, when collar 44 is rotated in one direction, collar threads 94 engage with leg rest support shaft threads 96 to extend leg rest support shaft 38 out of drive shaft 54, and raises leg rest 34. When collar 44 is rotated in the opposite direction, leg rest support shaft 38 retracts into drive shaft 54, to lower leg rest 34.

Since collar 44 is rotatably and captively mounted on drive shaft 54, it serves to couple leg rest support shaft 38 and drive shaft 54 together, in addition to providing for leg rest height adjustment. It will be recognized, however, that collar 44 does not have to be captive on drive shaft 54, and that other suitable means may be provided for preventing unintended separation of leg rest support shaft 38 from drive shaft 54.

The pitch of threads 94 and 96 is advantageously small to facilitate accurate and substantially continuous height adjustment. Friction between leg rest support shaft 38 and collar 44 may also help assure that a height adjustment is maintained once set.

Certain parts of device 24 are advantageously intended for user assembly, for example, to facilitate compact packaging, and it desirable to minimize the risk of incorrect assembly. Thus, according to some embodiments, leg rest support shaft 38 has a non-circular cross-section. Optionally, the cross-section is a regular polygon, for example, square or pentagonal, and has discontinuous threads, for example, only at the corners, to engage the threads on the adjusting collar.

Alternatively, the cross-section of the leg rest support shaft is circular.

Drive shaft interior opening 98 is formed with asymmetrically sized and spaced longitudinal ribs 100 (see FIG. 5), and leg rest support shaft 38 is shaped to match the configuration of ribs 100 so that it can fit into opening 98 only one way. Optionally, leg rest support shaft 38 may include projections (not shown) configured to fit between ribs 100. The arrangement describe assures that the front end 40*b* of leg rest 34 is properly oriented relative to housing body 30, as illustrated in FIG. 3. The complementary shape of leg rest support shaft 38 and drive shaft 54 also helps prevent leg rest support shaft 38 from rotating in drive shaft 54, and helps ensure stable vertical movement with minimum use of material.

The polygonal cross-section of leg rest support shaft 38 is accommodated in height adjusting collar 44 by having its threads 96 only at the corners (see FIG. 6).

Other constructions may alternatively be employed for leg rest height adjustment. For example, in one un-illustrated embodiment, the configurations of leg rest support shaft 38 and drive shaft 54 may be reversed so that the drive shaft fits telescopically into a tubular leg rest support shaft, with collar 44 mounted on the leg rest support shaft, and threadedly engaged with threads on the drive shaft. In such embodiments, the drive shaft may have a polygonal cross-section, and the interior of the leg rest support shaft may be configured to permit insertion of the drive shaft in only one orientation, and to prevent angular movement relative to the leg rest support.

In another un-illustrated embodiment, a cam mechanism, for example, mounted on housing body 30, leg rest support shaft 38, or drive shaft 54, may be employed to lock leg rest support shaft 38 relative to drive shaft 54.

Figure 8B:
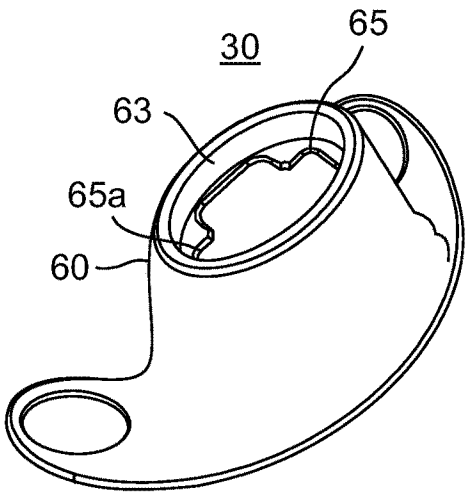
FIG. 8B is a perspective view of a drive unit housing body illustrating an example of how the bellows of FIG. 8A is attached to the body.
Figure 8A:
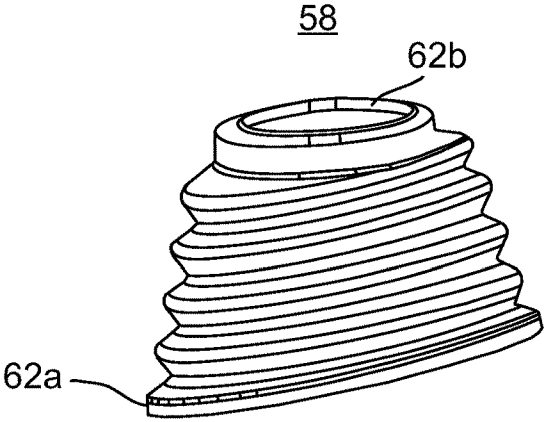
FIG. 8A is a perspective view of an exemplary cover, for example, a bellows, for the upper end of the drive unit housing according to some embodiments of the invention.

Referring again to FIG. 3 and to FIGS. 8A and 8B, a flexible cover, for example, a bellows 58 formed, for example, of a thermoplastic elastomer or thermoplastic rubber is positioned between the upper end 60 of housing body 30 and collar 44. Optionally, bellows 58 is captively mounted on housing 30 and drive shaft 54, for example, by an outwardly extending lip 62*a* at its lower end that engages an inwardly extending lip 63 on housing body 30 and an inwardly extending lip 62*b* at its upper end that fits in groove 88 below collar 44 on driveshaft 54. As will be understood, the width of groove 88 is sufficient to accommodate both tabs 90 on collar 44 and lip 62*b* without unduly restraining rotation of collar 44. Optionally, the fit in groove 88 can be close enough to contribute friction to the rotation of collar 44 that helps prevent slippage of the height adjustment setting.

The main function of bellows 58 is to provide a cover for the top of housing body 30. Because collar 44 is captive on drive shaft 54, it does not move longitudinally when the leg rest height is adjusted. Since bellows 58 is attached to collar 44 and to housing 30, it, too, does not move longitudinally, i.e., it does not stretch when the leg rest height is adjusted, but only when the drive shaft moves. Consequently, bellows 58 does not need to be long enough to accommodate the range of leg rest height adjustability, but only the motion imparted to drive shaft 54 by motion converter 52, and, the length of bellows 58 may in some instances be much less than the range of height adjustability of leg rest 34. For example, the stretched and unscratched lengths of bellows 58 may be in the range of 5-15 cm, or more or less. Since the material comprising bellows 58 may be relatively costly, the described design may help to reduce the overall cost of the device.

As noted above, motor 50 and crank 52 cooperate to provide a cyclical path of motion through drive shaft 54, and leg rest support assembly 36 to leg rest 34 that emulates the actions of a physical therapist. Optionally, the path of motion imparted to leg rest 34 is defined by a first component that is a primarily vertical lifting motion followed by a primarily horizontal tensioning motion. The return path is a primarily vertical lowering motion followed by a primarily horizontal releasing motion. The resulting path is substantially elliptical, with the long axis extending substantially horizontally.

Alternatively, however, the path of motion can be circular, or nearly circular.

Figure 9:
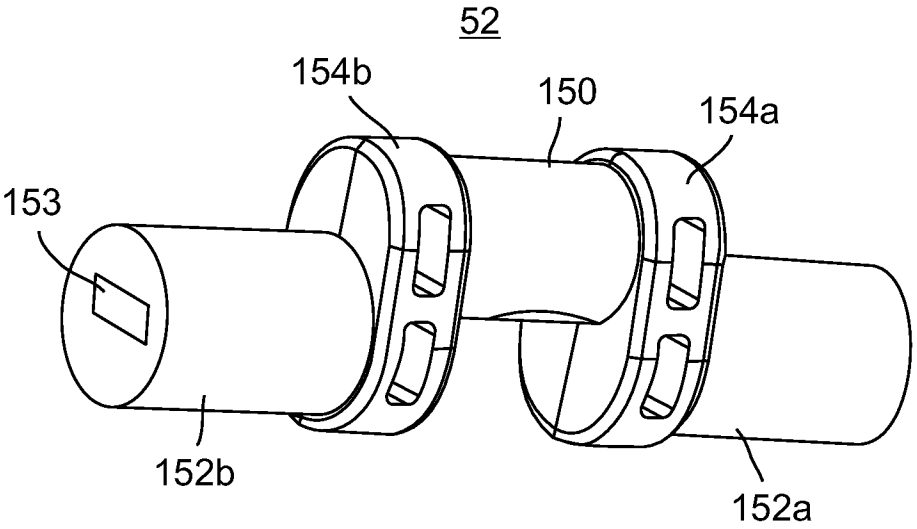
FIG. 9 is a primarily side elevation (slightly turned to the right into the plane of the drawing) of a motion converter according to some embodiments of the invention that transforms the rotary motion of a drive motor to the desired eccentric motion of the leg rest.

Referring to FIG. 9, an exemplary embodiment of crank 52 is comprised of a unitary molding, formed for example, of a polyoxymethylene (POM) acetyl copolymer, or other tough material with a very low coefficient of friction. Crank 52 is comprised of a pair of horizontally extending end tubes 152*a* and 152*b*, an offset central portion 150 which may be configured as a rod or a tube, and connecting intermediate portions 154*a* and 154*b* that provide a desired offset.

FIGS. 5, 10, 13A, and 13B show an exemplary arrangement for supporting, crank 52 and for connecting it to motor 50 and drive shaft 54. The arrangement illustrated includes three bearings: two end bearings 60*a* and 60*b*, and a two-piece main bearing comprised of like upper and lower sections 58*a* and 58*b*.

End bearings 60*a* and 60*b* are formed, for example, of a POM-acetal copolymer. In the illustrated example, bearings 60*a* and 60*b* are one-piece molded structures comprised of generally tubular portions 162 configured to receive end tubes 152*a* and 152*b* of crank 52 in a rotational relationship, and support collars 167 for spring mechanisms 56*a* and 56*b* (described below). Bearings 60*a* and 60*b* are mounted on housing body 30, for example, by means of screws 166 that pass through holes in ears 164 and which attach to the inside of drive unit housing body 30.

When assembled, tubular portions 162 of bearings 60*a* and 60*b* are positioned horizontally, and spring mechanism support collars 167 are positioned vertically.

Figure 10:
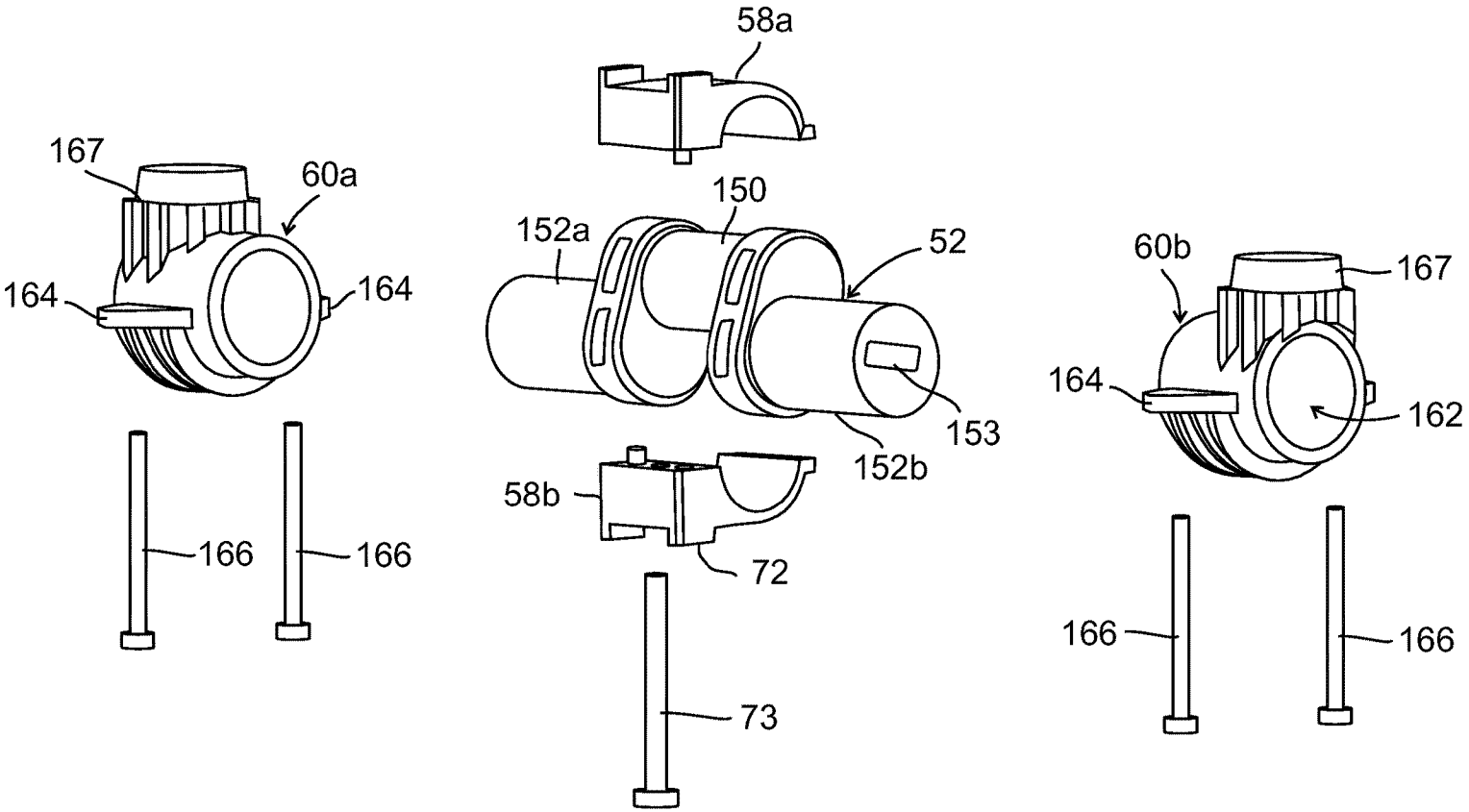
FIG. 10 is an exploded perspective view of the motion converter of FIG. 9, and an exemplary sub-assembly including the motion converter, end support bearings for the motion converter, and a main bearing for connecting the motion converter to the drive shaft according to some embodiments of the invention.

Referring to FIGS. 5, 10, and 11, to couple the output shaft 76 of the speed reduction mechanism 51, or optionally, of motor 50 itself, to motion converter 52 in a non-slip relationship, output shaft 76 is formed with an non-circular cross-section and crank end tubes 152*a* and 152*b* include an internal profile that matches that of the output shaft. For example, output shaft 76 can be triangular, square or rectangular etc, or can include one or more projections or ribs that fit into complementary longitudinal grooves or recesses 153 matching the shape of shaft 76. On assembly, shaft 76 is inserted in one of tubes 152*a* or 152*b* through the open end 162, for example, of end bearing 60*b*, as shown in FIG. 5.

It should be noted that crank (52) is formed as a symmetrical part, even though only one of tubes 152*a* or 152*b* is needed for receiving motor output shaft 76. This may be advantageous in that a symmetrical part is sometimes more easily molded than an asymmetrical part. Also, the symmetrical configuration can reduce or eliminate the possibility of assembly error since crank 50 can be attached to motor output shaft 76 by means of either of tubes 152*a* or 152*b*.

Figure 12:
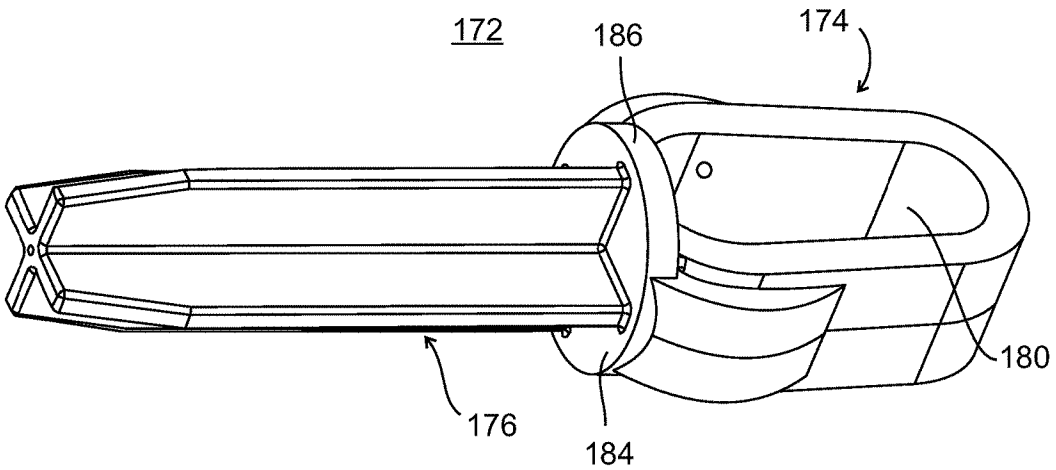
FIG. 12 is an enlarged perspective view of a spring assembly connecting rod according to some embodiments of the invention.

Referring to FIGS. 4, 5, and 12, spring mechanism assemblies 56*a* and 56*b* located on opposite sides of drive shaft 54 are like structures, each comprised of a compression spring 170 and a connecting guide rod 172, the latter formed, for example, of POM. Connecting rods 172 include head portions 174 and downwardly depending leg portions 176. Head portions 174 are formed with openings 180 configured to slidably receive mounting projections 178 that extend diametrically outward from drive shaft 54.

Upon assembly, connecting rod legs 176 extend through springs 170 and into support collars 167 on crank end bearings 60*a* and 60*b*, as previously indicated. The lower ends of springs 170 are positioned inside the upper ends of support collars 167. The upper ends of the springs rest against a lower surface 184 of peripheral rings 186 at the junctions of head portions 174 and legs 176 of connecting rods 172 (see FIGS. 4, 5, and 12).

The spring mechanisms are restrained; laterally in tracks 65*a* and 65*b* formed in base housing 30 (see FIG. 8B) and thereby provide support and lateral (side-to-side) alignment for drive shaft 54 as it moved by crank 52. The springs may also provide upward force to counterbalance the weight of the user's legs, which may reduce the torque required to be provided by motor 50.

Figure 13A:
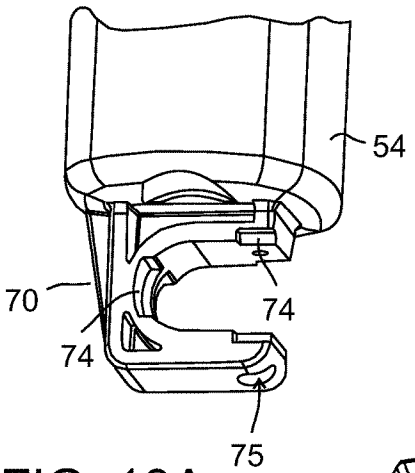
FIG. 13A is a fragmentary perspective view of an exemplary construction of the lower end of the drive shaft by which the motion converter main bearing is coupled to the drive shaft, according to some embodiments of the invention.
Figure 13B:
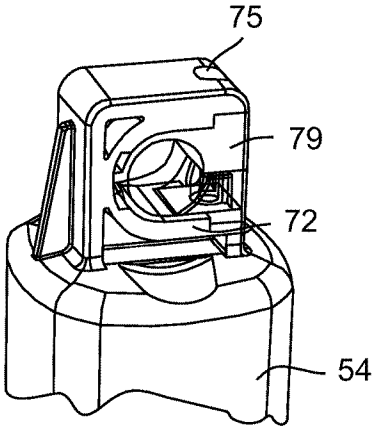
FIG. 13B shows the structure illustrated in FIG. 13A with the motion converter main bearing installed, according to some embodiments of the invention.
Figure 14:
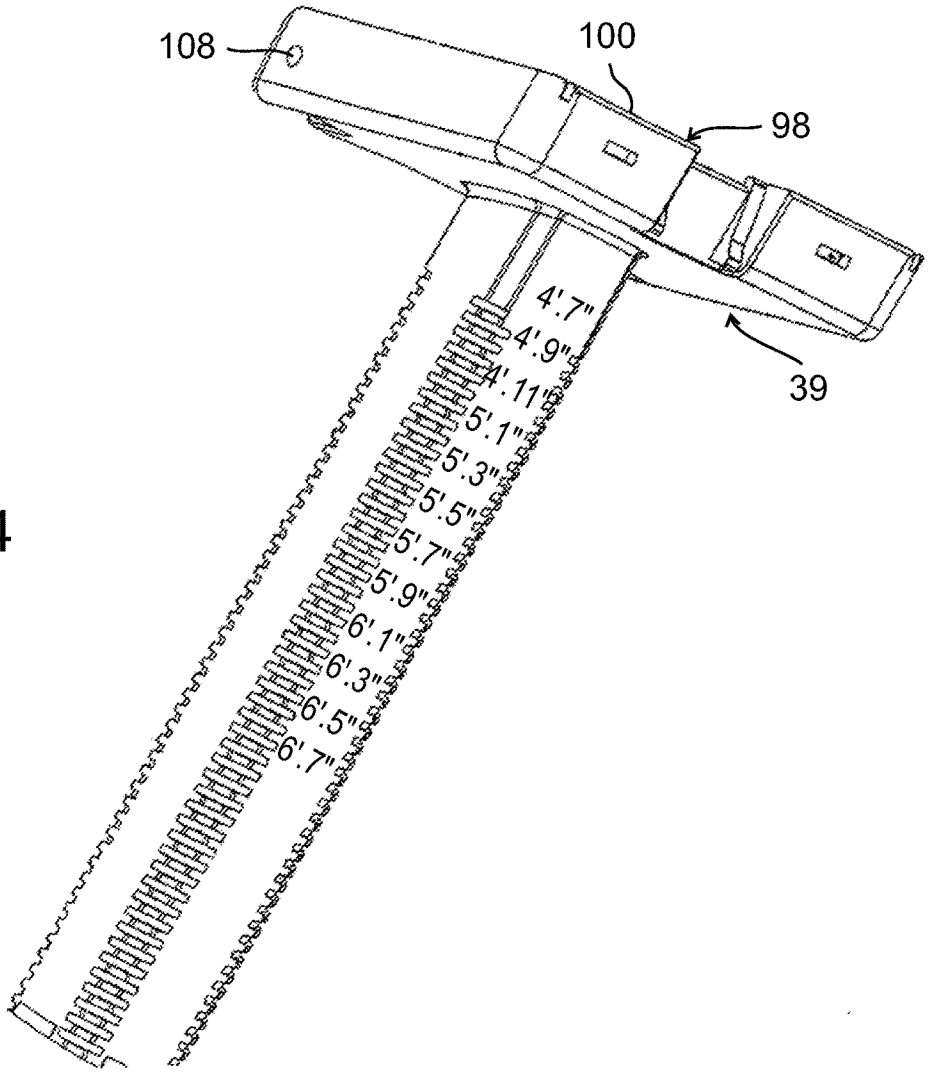
FIG. 14 is a perspective view seen generally from the front and above of a leg rest support shaft and a leg rest folding mechanism according to some embodiments of the invention.
Figure 15:
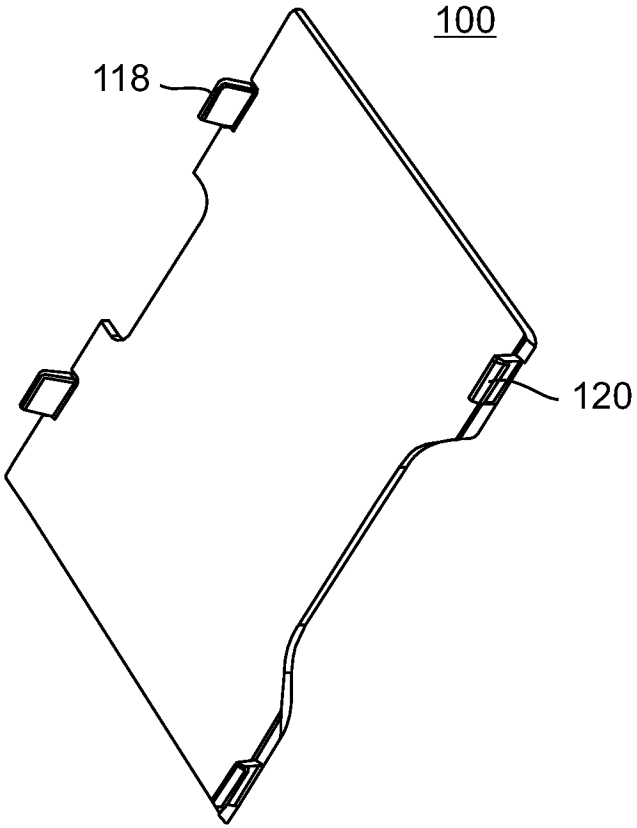
FIG. 15 is a perspective view seen from below of an optional cover for the folding mechanism of FIG. 14 according to some embodiments of the invention.

Referring again to FIG. 10 and to FIGS. 13A and 13B, crank 52 is rotatably connected to drive shaft 54 by a two-piece main bearing comprised of like sections 58*a* and 58*b* as noted above. The main bearing sections are assembled around central offset portion 150 of crank 52, and are installed in a U-shaped connector 70 at the lower end of drive shaft 54 (see FIGS. 13A and 13B). Main bearing sections 58*a* and 58*b* are secured in any suitable manner, for example, by a screw 73 that passes through a screw hole 75 and by tabs 72 on the bearing parts that fit into slots 74 in connector 70. The subassembly of main bearing 62 and the lower end of drive shaft 54 is illustrated in FIG. 13B.

It should be appreciated that drive unit 32 may be constructed in ways other than described above, for example as a single unit with an internal mechanism to provide the eccentric motion of drive shaft 54, and the consequent elliptical motion of the leg rest 34. As another example, in an un-illustrated embodiment, the motor may be a step motor operated by software to create the desired path of motion. Optionally, a user-operable adjustment may be provided to allow selection of the magnitude and repletion speed of the motion as desired.

Figure 18:
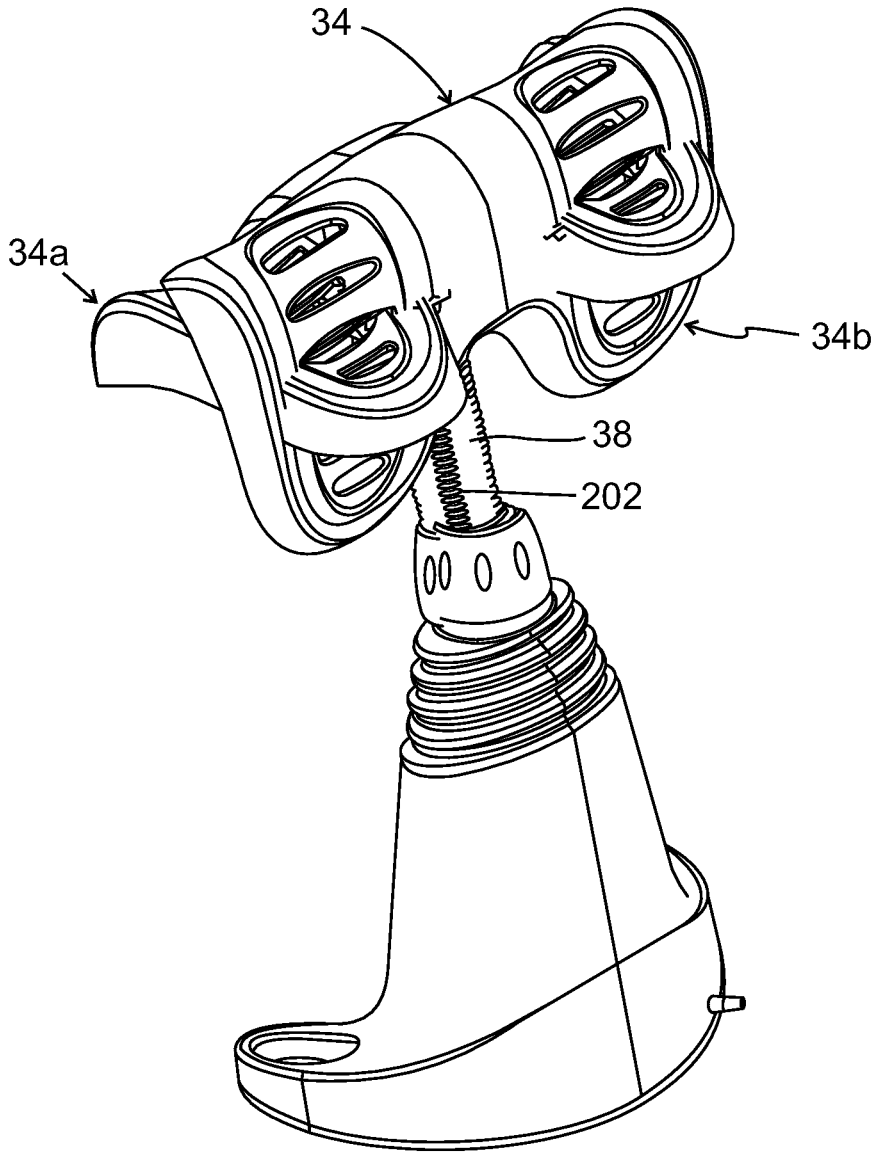
FIG. 18 is a composite perspective view seen generally from the front showing the leg rest in its operative and folded positions.

FIGS. 14-18 show an exemplary leg rest folding mechanism 39 for moving leg rest 34 between an operative position and a storage position according to some embodiments of the invention. FIG. 18 is a composite drawing that illustrates the two positions. In the operative position, indicated by 34*a*, leg rest 34 is positioned in substantially perpendicular relationship at the top of support shaft 38. In the storage position, indicated by 34*b*, leg rest 34 is folded down so that its front end 40*b* rests against the front side 202 of support shaft 38.

Figure 16:
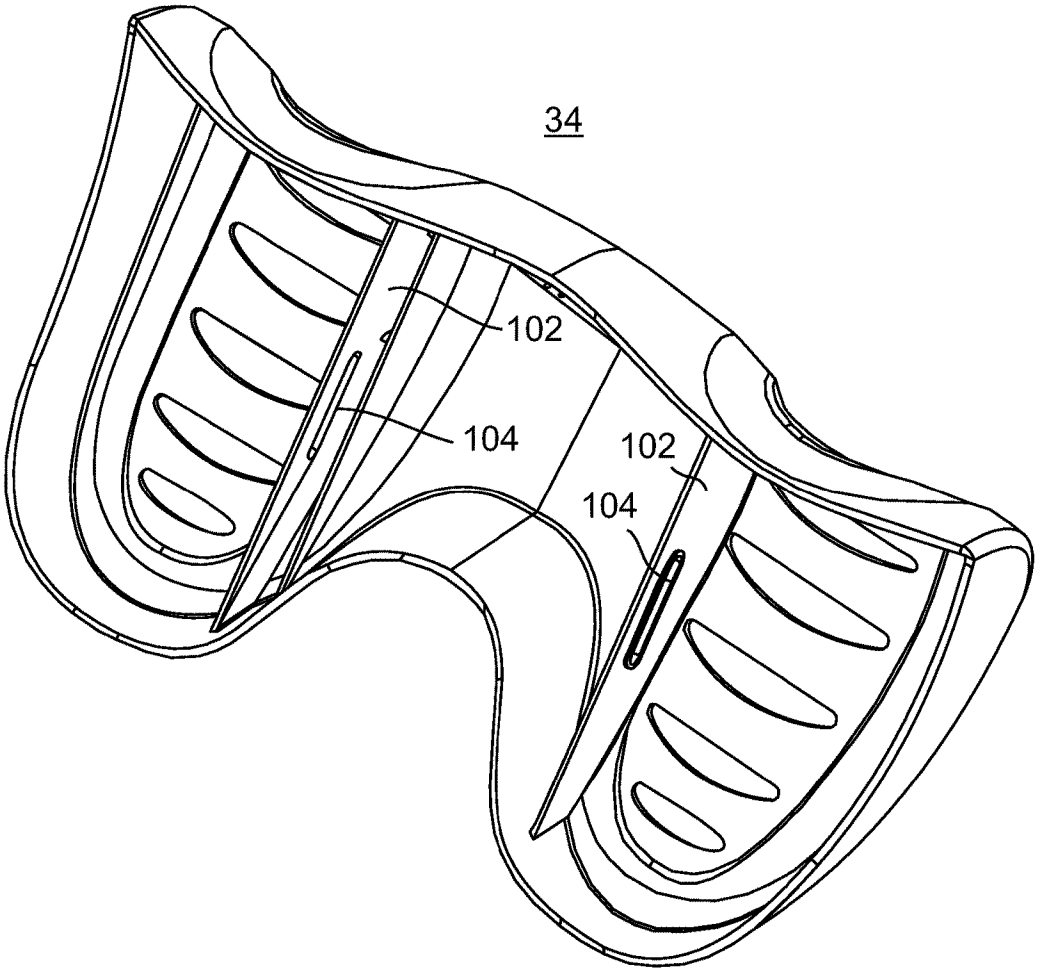
FIG. 16 is a perspective view seen from below of the bottom side of a leg rest with the front end at the bottom of the figure according to some embodiments of the invention.
Figure 17:
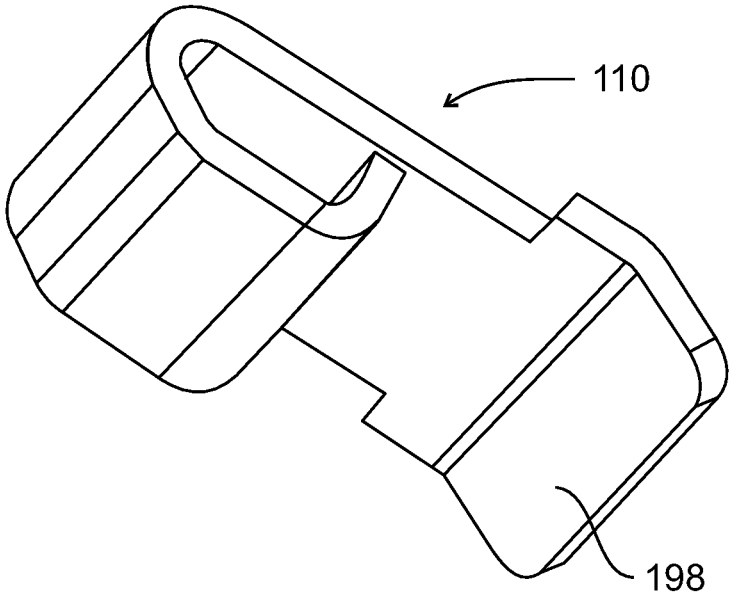
FIG. 17 shows an exemplary latch for retaining the leg rest in its operative position according to some embodiments of the invention.

Referring to FIGS. 14-18, folding mechanism 39 is comprised of a box-like member 98 formed, for example, of glass-filled polypropylene, that fits between two flanges 102 depending downwardly from the underside of leg rest 34 (see FIG. 16). An optional cover plate 100 is suitably secured on the top of member 98, for example by tabs 118 that fit into notches (not shown), and which is locked in place by hooks 120 that engage with undercut edges (not shown) on member 98. Alternatively, cover plate 100 may be secured by screws, or in any other suitable and desired manner, for example, by screws.

Referring to FIG. 16, in an exemplary embodiment, leg rest flanges 102 include a pair of opposed slots 104 defining a track that receives complementary guide elements, for example, pivot pins 106 (see FIG. 4), extending sideward from holes 108 on opposite sides of member 98. This arrangement connects leg rest 34 and member 98 together and allows the leg rest to slide and pivot.

Referring to FIGS. 5, 6, 8A-B, and 17, in some exemplary embodiments, leg rest 34 is locked in its operative position by a resilient latch 110 received in a slot 112 at the back of slide/pivot mechanism 39 and resiliently engages with the back of leg rest 34. Latch 110 includes a tab 198 which can be pressed to release the leg rest so it can slide and pivot to the storage position. To reposition leg rest 34 from its operative position to its storage position, the user lifts latch tab 198, slides leg rest 34 forward, then pivots it downward so that it lies along the front side 202 of shaft 38. To return leg rest 34 to the operative position, the user simply lifts leg rest front end 40*b* until it is perpendicular to shaft 38, and slides it back on pins 104 until latch 110 engages. The folding of the leg rest results in a smaller profile when viewed from above which may facilitate storage in confined spaces, for example, under a bed.

General Reference Information

As used herein the term "about" refers to ±10%.

The terms "comprises", "comprising", "includes", "including", "having" and their conjugates mean "including but not limited to". This term encompasses the terms "consisting of" and "consisting essentially of".

As used herein, the singular form "a", "an" and "the" include plural references unless the context clearly dictates otherwise.

The word "exemplary" is used herein to mean "serving as an example, instance or illustration". Any embodiment described as "exemplary" is not necessarily to be construed as preferred or advantageous over other embodiments and/or to exclude the incorporation of additional or alternative features.

The word "optionally" is used herein to mean "is provided in some embodiments and not provided in other embodiments". Any particular embodiment of the invention may include one or more "optional" features unless such features conflict.

Throughout this application, some dimensions and other parameter may be presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any fractional or integral value within the indicated range.

As used herein, the term "treating" includes abrogating, substantially inhibiting, slowing or reversing the progression of a condition, substantially ameliorating clinical or aesthetical symptoms of a condition or substantially preventing the appearance of clinical or aesthetical symptoms of a condition.

In should be appreciated that the illustrated embodiment and described variations is representative of a design using suitable conventional materials that has been optimized to provide a reliable and durable device that is less costly, but has the same functionality as the present unit. It is expected, however, that during the life of a patent maturing from this application other suitable material may become available, and that use of such materials is within the scope of the invention. Likewise, other designs that provide the desired functionality are to be considered within scope of the invention as described in the appended claims.

Further, it is to be understood that all publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A device for treating or preventing lower back pain comprising:

a leg rest;

a single shaft that supports the leg rest; and a leg rest folding mechanism that pivotally couples the leg rest to the support shaft to move the leg rest from an operational position substantially perpendicular to the support shaft to a storage position lying along the support shaft;

wherein the leg rest folding mechanism includes a pin mechanism and a guide track which cooperate to permit the leg rest to slide and pivot relative the leg rest support shaft.

2. A device according to claim 1, wherein the leg rest folding mechanism includes a slide mechanism mounted on the leg rest support shaft, wherein the pin mechanism comprises pins that project outwardly from the slide mechanism, and are slidably received in the guide track to permit the leg rest to slide toward a front end of the device and to pivot downwardly to the storage position.

3. A device for treating or preventing lower back pain comprising:

a leg rest;

a leg rest support assembly including a leg rest support shaft coupled to the leg rest;

a drive unit including a drive shaft coupled to the leg rest support assembly for imparting cyclic motion to the leg rest that emulates the motion performed by a physiotherapist;

a bellows forming a flexible cover for an upper end of a housing that contains the drive unit; and a leg rest height adjustment mechanism that cooperates with the leg rest support assembly to raise and lower the leg rest relative to the drive unit, wherein the length of the bellows is substantially unchanged during height adjustment and is only long enough to accommodate the cyclic motion of the drive shaft.

4. A device according to claim 3, wherein the bellows is attached at a lower end to the housing for the drive unit, and is attached at an upper end proximate to an upper end of the drive unit.

5. A device according to claim 3, wherein the leg rest height adjustment mechanism is captively mounted on the drive shaft and the upper end of the bellows is attached to the drive shaft below the leg rest height adjustment mechanism.

6. A device for treating or preventing lower back pain comprising:

a leg rest;

a leg rest support shaft;

a drive unit coupled to the leg rest support shaft for imparting cyclical motion to the leg rest that emulates the motion performed by a physiotherapist; and a height adjustment mechanism operative to move the leg rest support shaft relative to the drive unit to provide substantially continuous adjustment a height of the leg rest.

7. A device according to claim 6, wherein the height adjustment mechanism is an internally threaded collar that engages threads on the leg rest support shaft.

8. A device according to claim 6, wherein the threaded collar is captively mounted proximate to the upper end of the drive shaft.

9. A device according to claim 6, wherein the drive unit is mounted in a housing at the base of the device, and is comprised of:

a motor;

a drive shaft that couples the motor to the leg rest support shaft;

a motion converter between the motor and the drive shaft that imparts a cyclical path of motion to the leg rest support shaft; and a guide mechanism for providing lateral support for the drive shaft as it moves along the path of motion imparted by the motion converter.

10. A device according to claim 9, wherein the guide mechanism is comprised of guide rods located on opposite sides of the drive shaft that are moveably connected at their respective upper ends to projections extending from the drive shaft and are resiliently coupled at their lower ends to a support for the motion converter, and wherein the guide rods are received in longitudinal tracks located in the housing on opposite sides thereof.

11. A device according to claim 9, wherein the guide mechanism includes compression springs coupled to each of the guide rods that provide the resilient coupling and upward force when compressed for counterbalancing the weight of the user's legs.

12. A device according to claim 9, wherein the motion converter is a crank that includes a first end part coupled to the motor, a second end part, an offset center part rotatably coupled by a bearing to the drive shaft; and end bearings rotatably supporting the first and second end parts.

13. A device according to claim 12, wherein the guide rods include a shaft portion and a head portion transversely enlarged relative to the shaft portion, and the lower ends of the compression springs are mounted on the motion converter end bearings and the upper ends are in contact with the head portions of the guide rods.

14. A device according to claim 9, wherein the drive shaft is tubular, and is configured to receive a lower end of the leg rest support shaft in a telescoping relationship.

15. A device according to claim 14, wherein the leg rest support shaft and the drive shaft are configured such that leg rest support shaft can be received in the drive shaft in only one orientation.

16. A device according to claim 9, wherein the cross-section of the leg rest support shaft is a polygon threaded at its corners.

17. A device according to claim 9, wherein the leg rest is pivotally mounted on the leg rest support assembly so that the leg rest can be moved from an operative position to a folded position for storage.

18. A device according to claim 9, further including a bellows, a lower end of which is captively mounted at the top of a housing that contains the drive unit, and an upper end of which is captively mounted proximate to the upper end of the drive unit.

19. A device according to claim 18, wherein the length of the bellows does not change substantially during height adjustment of the leg rest.

20. A device according to claim 18, wherein the bellows is only long enough to accommodate the cyclic motion of the drive shaft.

* * * * *